US012576298B2

(12) United States Patent
Bentsen et al.

(10) Patent No.: US 12,576,298 B2
(45) Date of Patent: Mar. 17, 2026

(54) FITNESS SYSTEM, FITNESS ASSEMBLY ARRANGEMENT AND FUNCTIONAL FITNESS ELEMENTS

(71) Applicant: Kompan A/S, Odense SO (DK)

(72) Inventors: Nikolaj Maj Bentsen, Vejle Ø (DK); Rob Boogmans, Kerteminde (DK); Martin Nørgaard Johansen, Skårup Fyn (DK)

(73) Assignee: Kompan A/S, Odense (DK)

( * ) Notice: Subject to any disclaimer, the term of this patent is extended or adjusted under 35 U.S.C. 154(b) by 0 days.

(21) Appl. No.: 18/496,695

(22) Filed: Oct. 27, 2023

(65) Prior Publication Data

US 2024/0066342 A1 Feb. 29, 2024

Related U.S. Application Data

(63) Continuation of application No. 17/661,633, filed on May 2, 2022, now Pat. No. 11,850,502, which is a (Continued)

(30) Foreign Application Priority Data

Jul. 10, 2015 (EP) ..... 15176288

(51) Int. Cl.
*A63B 9/00* (2006.01)
*A63B 1/00* (2006.01)

(Continued)

(52) U.S. Cl.
CPC ..... *A63B 9/00* (2013.01); *A63B 1/00* (2013.01); *A63B 7/00* (2013.01); *A63B 7/02* (2013.01);

(Continued)

(58) Field of Classification Search
CPC ..... A63B 21/06–159; A63B 69/20–30
See application file for complete search history.

(56) References Cited

U.S. PATENT DOCUMENTS 426,944 A * 4/1890 Lovatt ..... A63B 69/30 482/89
1,126,082 A 1/1915 Reach (Continued)

FOREIGN PATENT DOCUMENTS

CN 202409978 U 9/2012
CN 203634716 U 6/2014

(Continued)

OTHER PUBLICATIONS

European Search Report mailed May 11, 2016 in European Application No. EP 15176288 (2 pages).

(Continued)

*Primary Examiner* — Nyca T Nguyen
(74) *Attorney, Agent, or Firm* — Bookoff McAndrews, PLLC

(57) ABSTRACT

A suspension training based functional fitness element (11, 31) comprising: an essentially planar element (22) having an upper edge, a lower edge and two side edges, said planar element (22) being designed to form a pivotable connection to a support element (32) along said upper edge of the planar element (22), a first elongated element (23, 32, 52) connected to said planar element (22) at a first connection point at said lower edge of the planar element (22), a second elongated element (23, 32, 52) connected to said planar element (22) at a second connection point at said lower edge of the planar element (22), and a first and second handle (24), said first and second handle (24) being connected to said first and second elongated elements (23) respectively, whereby that said first and second connection points are arranged such that there is a horizontal offset between the (Continued)

first and second connection points and such that there is a vertical offset between the first connection point and the pivotable connection and a vertical offset between the second connection point and the pivotable connection.

17 Claims, 10 Drawing Sheets

Related U.S. Application Data continuation of application No. 15/742,942, filed as application No. PCT/EP2016/066436 on Jul. 11, 2016, now Pat. No. 11,344,762.

(51) Int. Cl.

| | |
|---|---|
| ***A63B 7/00*** | (2006.01) |
| ***A63B 7/02*** | (2006.01) |
| ***A63B 17/04*** | (2006.01) |
| ***A63B 21/00*** | (2006.01) |
| ***A63B 21/02*** | (2006.01) |
| ***A63B 21/04*** | (2006.01) |
| ***A63B 21/055*** | (2006.01) |
| ***A63B 21/062*** | (2006.01) |
| ***A63B 22/00*** | (2006.01) |
| ***A63B 23/035*** | (2006.01) |
| ***A63B 71/00*** | (2006.01) |
| ***A63G 31/00*** | (2006.01) |
| ***A63G 31/02*** | (2006.01) |

(52) U.S. Cl.

CPC ..... *A63B 17/04* (2013.01); *A63B 21/023* (2013.01); *A63B 21/055* (2013.01); *A63B 21/0557* (2013.01); *A63B 21/0626* (2015.10); *A63B 21/151* (2013.01); *A63B 21/4023* (2015.10); *A63B 21/4035* (2015.10); *A63B 21/4045* (2015.10); *A63B 22/0005* (2015.10); *A63B 23/03525* (2013.01); *A63B 71/0054* (2013.01); *A63G 31/00* (2013.01); *A63G 31/02* (2013.01); *A63B 2009/002* (2013.01); *A63B 2009/006* (2013.01); *A63B 21/0442* (2013.01); *A63B 2071/0063* (2013.01); *A63B 2208/0204* (2013.01); *A63B 2208/12* (2013.01); *A63B 2225/105* (2013.01)

(56) References Cited

U.S. PATENT DOCUMENTS

| | | | | |
|---|---|---|---|---|
| 1,386,206 | A | 8/1921 | Ludvig | |
| 1,554,409 | A | 9/1925 | Coffee | |
| 2,249,309 | A | 7/1941 | Ivan | |
| 2,929,627 | A | 3/1960 | Scanlon | |
| 2,977,118 | A | 3/1961 | Farkas | |
| 3,058,742 | A | 10/1962 | Sarah | |
| 3,526,399 | A | 9/1970 | Hjelte | |
| 3,545,121 | A | 12/1970 | Misko | |
| 3,547,435 | A | 12/1970 | Scott | |
| 3,640,528 | A | 2/1972 | Proctor | |
| 3,685,511 | A | 8/1972 | Alvarez | |
| 3,756,593 | A | 9/1973 | Lehr | |
| 3,849,933 | A | 11/1974 | Kuntz | |
| 3,850,428 | A | 11/1974 | Zuber | |
| 3,912,263 | A | 10/1975 | Yatso | |
| 3,937,461 | A | 2/1976 | Lew | |
| 3,957,266 | A | 5/1976 | Rice | |
| 4,084,812 | A | 4/1978 | Melrose et al. | |
| 4,149,714 | A | 4/1979 | Lambert, Jr. | |
| 4,169,591 | A | 10/1979 | Douglas | |
| 4,278,250 | A | 7/1981 | Baynes et al. | |
| 4,456,245 | A | 6/1984 | Baldwin | |
| 4,456,246 | A | 6/1984 | Szabo | |
| 4,487,413 | A | 12/1984 | Fall | |
| 4,531,729 | A | 7/1985 | Wrinkle | |
| 4,627,617 | A | 12/1986 | Gilmore et al. | |
| 4,729,561 | A | 3/1988 | Desjardins | |
| 4,744,560 | A | 5/1988 | Azari | |
| 4,832,631 | A | 5/1989 | Gag | |
| 4,902,002 | A | 2/1990 | Huang | |
| 4,966,367 | A | 10/1990 | Oyarzabal | |
| 4,974,837 | A | 12/1990 | Someya et al. | |
| 5,054,713 | A | 10/1991 | Langley et al. | |
| 5,145,472 | A | 9/1992 | Johnson, III et al. | |
| 5,158,518 | A | 10/1992 | Pizzuto | |
| 5,162,030 | A | 11/1992 | Tanski | |
| 5,184,992 | A | 2/1993 | Banks | |
| 5,277,680 | A | 1/1994 | Johnston | |
| 5,334,098 | A | 8/1994 | Pope et al. | |
| 5,354,249 | A | 10/1994 | Raley | |
| 5,421,797 | A * | 6/1995 | Fletcher | A63B 21/0728 482/106 |
| 5,474,511 | A | 12/1995 | Dantolan | |
| 5,536,229 | A | 7/1996 | Albergo | |
| 5,921,895 | A | 7/1999 | Lynch et al. | |
| 6,234,938 | B1 | 5/2001 | Chen | |
| 6,315,702 | B1 | 11/2001 | Ikonomopoulos | |
| 6,348,028 | B1 | 2/2002 | Cragg | |
| 6,361,481 | B1 | 3/2002 | Koenig | |
| 6,464,619 | B1 | 10/2002 | Bondi | |
| 6,491,609 | B2 | 12/2002 | Webber | |
| 6,503,174 | B2 | 1/2003 | Mantooth | |
| 6,663,542 | B1 | 12/2003 | Trabbic | |
| 6,736,764 | B1 | 5/2004 | Kapustka | |
| D515,166 | S | 2/2006 | Montfort | |
| 7,060,002 | B1 | 6/2006 | Boehme | |
| 7,094,185 | B2 | 8/2006 | Greenland | |
| 7,594,880 | B2 | 9/2009 | Webber et al. | |
| 7,695,411 | B2 | 4/2010 | Pandozy | |
| D629,472 | S | 12/2010 | Rhodes | |
| 7,927,260 | B1 | 4/2011 | Stalka | |
| 7,959,513 | B2 | 6/2011 | Ochi | |
| 8,012,047 | B2 | 9/2011 | Gamboa | |
| 8,057,368 | B1 | 11/2011 | Lyszczarz | |
| 8,147,389 | B1 | 4/2012 | Hoole | |
| 8,241,182 | B2 | 8/2012 | Julskjaer et al. | |
| D692,967 | S | 11/2013 | Alessandri et al. | |
| 8,979,720 | B2 | 3/2015 | Brentham et al. | |
| 9,126,069 | B2 | 9/2015 | Ochi | |
| 9,452,309 | B2 | 9/2016 | Scaramucci | |
| 9,492,706 | B1 | 11/2016 | Turnbow | |
| 9,889,363 | B1 | 2/2018 | Myrick | |
| 9,901,766 | B2 * | 2/2018 | Ross | A63B 22/0005 |
| 10,004,933 | B2 | 6/2018 | Lennox et al. | |
| 2002/0091041 | A1 | 7/2002 | Mantooth | |
| 2002/0094917 | A1 | 7/2002 | Wang | |
| 2002/0198085 | A1 | 12/2002 | Wang | |
| 2003/0003840 | A1 | 1/2003 | Hsu et al. | |
| 2003/0013579 | A1 | 1/2003 | Rennex | |
| 2003/0060333 | A1 | 3/2003 | Sudeith | |
| 2004/0058788 | A1 | 3/2004 | Thompson | |
| 2004/0090011 | A1 | 5/2004 | Al-Harbi | |
| 2004/0110607 | A1 | 6/2004 | Crespo | |
| 2004/0266591 | A1 | 12/2004 | Alessandri et al. | |
| 2005/0070407 | A1 | 3/2005 | Alessandri et al. | |
| 2006/0223676 | A1 | 10/2006 | Rote | |
| 2006/0247101 | A1 | 11/2006 | Hall | |
| 2006/0252616 | A1 | 11/2006 | Gerschefske | |
| 2007/0032357 | A1 | 2/2007 | Piane | |
| 2007/0078014 | A1 | 4/2007 | Nye et al. | |
| 2007/0082791 | A1 | 4/2007 | Reese et al. | |
| 2007/0184941 | A1 | 8/2007 | Krietzman | |
| 2007/0265142 | A1 | 11/2007 | Hwang | |
| 2008/0026918 | A1 | 1/2008 | Lemke et al. | |
| 2008/0051257 | A1 | 2/2008 | Hamblin et al. | |
| 2008/0081741 | A1 | 4/2008 | Sargen et al. | |
| 2008/0139367 | A1 | 6/2008 | Cooper | |
| 2008/0146423 | A1 | 6/2008 | Ammon et al. | |
| 2008/0176724 | A1 * | 7/2008 | Chrysanthus | A63B 21/0728 482/107 |
| 2008/0234116 | A1 | 9/2008 | Elzerman | |

(56) References Cited

U.S. PATENT DOCUMENTS

| | | | | |
|---|---|---|---|---|
| 2009/0197740 | A1 | 8/2009 | Julskjaer et al. | |
| 2010/0087302 | A1 | 4/2010 | Fukunaga | |
| 2010/0137112 | A1 | 6/2010 | Harker | |
| 2010/0179029 | A1 | 7/2010 | Ochi | |
| 2011/0070569 | A1 | 3/2011 | Martens | |
| 2011/0172064 | A1 | 7/2011 | Cutler et al. | |
| 2011/0207101 | A1 | 8/2011 | Garner | |
| 2011/0237405 | A1 | 9/2011 | Reyes | |
| 2011/0319230 | A1 | 12/2011 | Brendle | |
| 2012/0053028 | A1 | 3/2012 | Campanaro et al. | |
| 2012/0129660 | A1 | 5/2012 | Eem | |
| 2012/0142503 | A1 | 6/2012 | Sevadjian et al. | |
| 2012/0157266 | A1 | 6/2012 | Todokoro | |
| 2012/0252637 | A1 | 10/2012 | Pellot | |
| 2013/0065735 | A1 | 3/2013 | Conarty | |
| 2013/0109543 | A1 | 5/2013 | Reyes | |
| 2013/0184128 | A1 | 7/2013 | Towley, III et al. | |
| 2013/0213917 | A1 | 8/2013 | Prieto | |
| 2013/0324372 | A1 | 12/2013 | Cuadrado et al. | |
| 2014/0073496 | A1 | 3/2014 | Bannerman | |
| 2014/0094350 | A1 | 4/2014 | Sagall | |
| 2014/0106938 | A1 | 4/2014 | Sudeith et al. | |
| 2014/0128228 | A1 | 5/2014 | Bonomi | |
| 2014/0274587 | A1 | 9/2014 | Ruggiero et al. | |
| 2014/0274606 | A1 | 9/2014 | Piskin et al. | |
| 2015/0059257 | A1 | 3/2015 | Beaver et al. | |
| 2015/0099613 | A1 | 4/2015 | Saez | |
| 2015/0111708 | A1 | 4/2015 | Smith | |
| 2015/0118670 | A1 | 4/2015 | Jespersen et al. | |
| 2015/0141205 | A1 | 5/2015 | Garland | |
| 2015/0157891 | A1 | 6/2015 | Mellott | |
| 2015/0196119 | A1 | 7/2015 | Henniger | |
| 2015/0321048 | A1* | 11/2015 | Ross | A63B 22/0005 482/92 |
| 2015/0335932 | A1 | 11/2015 | Chen | |
| 2015/0343257 | A1 | 12/2015 | Cooper | |
| 2016/0001119 | A1 | 1/2016 | Jue et al. | |
| 2016/0101337 | A1 | 4/2016 | Hsu | |
| 2016/0129326 | A1* | 5/2016 | Ozkaya | A63B 69/0053 482/83 |
| 2016/0184164 | A1 | 6/2016 | Browning | |
| 2016/0317894 | A1* | 11/2016 | Salcedo | A63B 37/06 |
| 2017/0021223 | A1 | 1/2017 | Ramsey et al. | |
| 2017/0087395 | A1 | 3/2017 | Kinziger | |
| 2017/0087435 | A1 | 3/2017 | Jones et al. | |
| 2017/0216679 | A1 | 8/2017 | McCoy | |
| 2017/0259101 | A1 | 9/2017 | Im | |
| 2018/0036573 | A1 | 2/2018 | Lennox et al. | |
| 2020/0261765 | A1 | 8/2020 | Jones | |

FOREIGN PATENT DOCUMENTS

| | | | |
|---|---|---|---|
| DE | 202010000094 | U1 | 5/2010 |
| DE | 202013100237 | U1 | 1/2013 |
| DE | 202014006737 | U1 | 10/2014 |
| WO | 03047701 | A1 | 6/2003 |
| WO | 2009095283 | A2 | 8/2009 |
| WO | 2012172098 | A1 | 12/2012 |
| WO | 2016039752 | A1 | 3/2016 |

OTHER PUBLICATIONS

International Search Report mailed Nov. 15, 2016 in International Application No. PCT/EP2016/066436 (5 pages).

Official Communication in corresponding European Patent Application No. 16738141.7, dated Jun. 15, 2020 (6 pages).

Search Report issued in European Application No. 23181759.4, issued on Oct. 2, 2023.

* cited by examiner

FITNESS SYSTEM, FITNESS ASSEMBLY ARRANGEMENT AND FUNCTIONAL FITNESS ELEMENTS

CROSS-REFERENCE TO RELATED APPLICATIONS

This application is a continuation of U.S. patent application Ser. No. 17/661,663, filed on May 2, 2022, which is a continuation application of U.S. patent application Ser. No. 15/742,942, filed on Jan. 9, 2018, now U.S. Pat. No. 11,344,762, which is the U.S. national phase entry under 35 U.S.C. § 371 of International Application No. PCT/EP2016/066434, filed on Jul. 11, 2016, which claims priority to European Patent Application No. 15176288.7, filed on Jul. 10, 2015, the entireties of which are herein incorporated by reference.

The current invention relates to a fitness system which has a frame element and different functional fitness elements to allow the creation of different fitness assemblies.

In the current specification, a fitness system should be understood as a collection of fitness elements which can be manufactured, sold and used as a system to provide different fitness activities. In the current specification the term "fitness" is used throughout. The term fitness when related to an element, a system, an arrangement etc should be understood as describing an element, a system, an arrangement, etc which provides or makes possible some form of physical training activity. This could be, for example, for training balance, strength, explosiveness, endurance, etc. . . .

In the current specification, a functional fitness element should be understood as an element which comprises different mechanical components to provide an element on which a user can train one or more fitness exercises. In the current specification, a frame element is understood as a mechanical structure which is designed to be erected on a support surface in order to provide support to a functional fitness element mounted to the frame element. It should be mentioned that the frame element should be a clearly identifiable unique component of the system. There are many fitness structures in the prior art which are made up of different components which can be assembled into frames to support functional fitness elements. For example U.S. Pat. No. 1,126,082 discloses a system comprising a frame structure which is composed of a number of different elongated elements connected with corner pieces. The elongated elements are connected into a frame structure. However, there is no clearly identifiable standard frame element in the frame structure of U.S. Pat. No. 1,126,082. It is just one big structure. In the system according to the current invention, there is a clearly identifiable frame element which is connected with other elements in the system, but the unique frame elements are clearly identifiable. See for example FIG. 20, which clearly shows two unique frame elements joined with a link element.

Other examples of structures comprising different elements joined together are for example disclosed in US2015118670, WO 2009095283 and U.S. Pat. No. 4,278,250. In all these disclosed structures, different structural elements are provided to allow the creation of many different types of frame structures. This is different from the current invention, where a standard frame element is provided with different functional fitness elements connected thereto.

A fitness assembly should be understood as an assembly which comprises both a frame element and a functional fitness element mounted to the frame element. The term fitness machine is also sometimes used to refer to a fitness assembly, but the term fitness assembly should be understood broader than the term fitness machine.

The current invention also relates to a fitness assembly arrangement which comprises multiple fitness assemblies made up of different elements of the fitness system of the current invention.

According to the current specification, the term "fitness assembly arrangement" should be understood as a collection of different fitness assemblies erected together in a common location. For example, a group of fitness machines placed in a single room would be considered a fitness assembly arrangement. Likewise, a group of fitness assemblies erected outside in a park would be considered a fitness assembly arrangement. Instead of the term "fitness assembly arrangement" the term "arrangement of fitness assemblies" could also be used.

A related, but independent invention, is provided in the form of a weight lifting based functional fitness element comprising an elongated structure having a first end and a second end, and a weight element designed to be lifted directly by a user, said elongated structure being designed to be supported such that the first end is above the second end whereby the first end becomes an upper end and the second end becomes a lower end and such that an axis passing through the upper and lower ends of said elongated structure is arranged at an angle of less than 15 degrees, less than 10 degrees, or less than 5 degrees to the vertical, said weight element being displaceably fastened to the elongated structure such that the weight element is displaceable along the elongated structure.

According to the current specification the term "weight element" should be understood as an object which is to be lifted by a user as a form of exercise. The weight element has a certain weight which is suitable for the exercise being performed.

In the claims it is stated that the weight element is "designed to be lifted directly by a user". This should be understood in that the user will be lifting the actual weight element directly without any further mechanisms between the user and the weight element. For example, a user will lift the weight element via a handle connected directly to the weight element. In contrast, in many prior art systems, the user lifts a weight element via a pulley mechanism of some sort via a cable.

In the claims it is stated that the weight element is displaceably fastened to an "elongated structure". According to the current specification, the term "elongated structure" should be understood as a mechanical structure which controls the displacement of the weight element. In many prior art systems, a weight lifting barbell is arranged between two vertically arranged elongated elements which catch the barbell if the user drops the barbell. The two elongated elements would be considered to form an elongated structure together according to the current invention. It could be interpreted that both elongated elements of the prior art systems could be understood as an independent elongated structure, however, according to the current invention, it is understood that the two elements together control the motion of the weight element and as such they are both parts of a single elongated structure.

The terms "upper and lower ends" should be understood as the upper and lower ends of the elongated structure. The claims refer to an axis passing through the upper and lower ends. In the case of an elongated structure having a large cross sectional area, then for the sake of defining the axis, the centre point of the cross sectional area of the upper and lower ends should be used.

Another related, but independent invention is provided in the form of a suspension training based functional fitness element comprising: an essentially planar element having an upper edge, a lower edge and two side edges, said planar element being designed to form a pivotable connection to a support element along said upper edge of the planar element, a first elongated element connected to said planar element at a first connection point at said lower edge of the planar element, a second elongated element connected to said planar element at a second connection point at said lower edge of the planar element, and a first and second handle, said first and second handle being connected to said first and second elongated elements respectively.

In the claims, the term "planar element" should be understood as an object having a width, a height and a length where one of the three dimensions is much smaller than the others. In one embodiment, the dimension is at least 5 times smaller than the others. In another embodiment, the dimension is at least 10 times smaller than the others.

It should also be noted that a "support element" is mentioned in the claims. However, for the sake of the scope of protection, it should be noted that the "support element" is not a part of the functional fitness element itself. Rather the functional fitness element is designed to be connected to a support element.

Another related, but independent invention is provided in the form of a twisting action functional fitness element comprising: a stiff elongated element comprising: a first end, a second end, a first gripping element arranged between the first and second ends, where said first gripping element is offset from an axis which passes through the first and second ends such that a user applying force to the gripping element in a direction perpendicular to said axis can apply a moment to the elongated element about said axis, and a load providing element arranged to provide resistance to pivotal motion of the stiff elongated element.

According to the current specification, the term "load providing element" should be understood as an object which provides a load to the user of the fitness element via which the user can train his or her body.

DESCRIPTION OF RELATED ART

Fitness machines are well known and many different arrangements of fitness machines are known. Typically fitness machines are part of a fitness system which comprises many different fitness machines, each providing different training exercises. For example a fitness system could comprise one fitness machine which trains the upper body and another fitness machine which trains the lower body.

These fitness machines are typically provided as a fitness assembly which comprises a frame and a functional fitness element. The frame is designed to support the functional fitness element on a support surface. However it is common for many different fitness systems that the different functional fitness elements have different frames. Each frame is optimized for the specific functional fitness element mounted to the frame.

As a consequence, a large number of different frames need to be designed and manufactured. This raises the cost of the individual fitness elements in the system and also leads to more complex stocking systems for the companies manufacturing and/or selling the systems. Furthermore, in many cases, since the typical fitness machines in a system have different frame elements, when arranging different fitness machines into a fitness machine arrangement, the overall visual impression will be that of a number of individual machines set up without any form of logical link between the machines. A disorganized visual impression will then typically be provided by the arrangement.

A fitness system can often be identified by common graphical elements or common structural elements which are shared between the different fitness machines. Such common graphical or structural elements provide a visual impression of unity to the fitness machines when they are erected as a group of fitness machines. A fitness system can also often be identified by reviewing the marketing materials of the manufacturer of fitness machines. Typically different fitness machines will be marketed and sold as part of a system of fitness machines.

Furthermore, very many different functional fitness elements are disclosed in the prior art. Known functional fitness elements all have both positive and negative features.

SUMMARY OF THE INVENTION

A first aspect of the current invention is therefore to provide a fitness system which is cheaper to manufacture.

A second aspect of the current invention is to provide a fitness system which is less complex to stock.

A third aspect of the current invention is to provide a fitness system which provides a greater unified visual impression when an arrangement of different fitness assemblies is setup.

This is in part provided via a fitness system comprising: a standard frame element designed to be erected on and supported by a supporting surface, a first functional fitness element, a second functional fitness element, said second functional fitness element being different than said first functional fitness element, said standard frame element and said first and second functional fitness elements being designed to allow the creation of: a first fitness assembly comprising one standard frame element and one first functional fitness element mounted to and supported by said standard frame element, and a second fitness assembly comprising one standard frame element and one second functional fitness element mounted to and supported by said standard frame element.

By providing such a system, the manufacturer of the system only has to produce one standard frame element and then multiple different functional fitness elements can be attached to and supported by the standard frame element. Instead of having to manufacture and stock many different types of frame elements, only a single variant needs to be made. Of course, additional frame elements could also be provided if necessary, but in general, a single frame element forms the basis for the fitness system according to the current invention.

It should be understood that the current invention is related to a system of elements, which system results in a series of different elements which are then manufactured by one or more manufactures so that they can be assembled into different assemblies.

The system could also be arranged with additional functional fitness elements which allow the creation of multiple other fitness assemblies and thereby further expand the possibilities provided by the system.

In one embodiment, the standard frame element has a length, a width and a height, and the length can be arranged to be more than two or more than three times greater than said width. In this way, a longer and narrower structure can be provided in contrast to a more square structure which is common in the prior art fitness machines.

In an embodiment where the standard frame element and the functional fitness elements are designed such that a fitness assembly can be provided comprising a standard frame element and two or three identical or different functional fitness elements mounted to and supported by said standard frame element, said two or three functional fitness elements being arranged alongside each other along the length axis of the standard frame element such that there is room for two or three people respectively to simultaneously use said functional fitness elements alongside each other, the capacity of the system can be increased without increasing the number of frame assemblies needed. Since the frame assembly itself and the establishment of proper support for the frame assembly on the supporting surface is in many cases a costly component of the system, reducing the number of frame elements while increasing capacity gives extra benefits to the system. Especially reducing the number of foundations required to setup a fitness arrangement, can provide a large economic benefit. For example, a frame element could be provided with two or three or more fitness stations while having 3 or 4 or fewer foundations.

In an embodiment where the standard frame element and the two or three identical or different functional fitness elements are designed such that it is possible for two or three people to use the functional fitness elements simultaneously while their bodies are facing perpendicular to the length axis of the standard frame element an assembly can be provided where the users can work side by side, but without looking at each other. When working face to face, most users will require a larger personal space. However, when working side by side, users can work closer together without the same requirement for a large personal space.

In an embodiment where said standard frame element has a form where one side edge of the frame element is wider than the other side edge a tapered frame is provided when looking at it from above. This has a number of benefits as discussed further in the text below.

In an embodiment where said fitness system further comprises a link element, said standard frame element and said link element being designed to allow the creation of a fourth fitness assembly comprising two standard frame elements and one link element where said two standard frame elements are arranged adjacent to each other and the link element is mounted between and supported by the two adjacent standard frame elements, said link element being designed to allow a functional fitness element to be mounted to and supported by said link element a system is provided which further increases the possible capacity of users working on the system at once. Furthermore, the number of different functional exercises made possible by a single arrangement of fitness assemblies will be increased without increasing the number of frames required. Again, the number of foundations required to properly support the arrangement will be decreased while still providing a large number of different exercises.

The current invention relates mainly to a system of elements. However, the claims also relate to an arrangement of fitness assemblies made up of fitness elements according to the system specified in this specification. Some embodiments relate to different embodiments of different physical arrangements of fitness assemblies assembled on a support surface whereas some embodiments relate to the concept of a system of different elements which make different assemblies possible.

Another aspect covered by the current specification is to provide additional functional fitness elements which provide additional benefits over the solutions known in the prior art.

The current specification therefore also discloses another related but independent invention, namely a weight lifting based functional fitness element as described in the introductory portion of this specification but where the elongated structure has a dimension perpendicular to said axis of less than 20 cm, less than 15 cm, or less than 10 cm. By using a narrow elongated structure, a more simple system can be provided. In most cases, the elongated structure can be provided by a single narrow element. When having a narrow element, the forces on the structure are minimized and there is less risk that the weight element "binds" on the elongated structure. Furthermore, instead of having the user stand "in" the elongated structure as in the prior art, in the current setup, the user will be typically be standing around the elongated structure, and typically be facing the elongated structure with his or her upper body depending on the specific exercise.

In an embodiment, a simple mechanical solution is provided. By "linear elongated structure" is meant a structure which is arranged as a straight line between the two ends. The linear structure could either be provided by a stiff elongated element in the form of a rod, pole, pipe, etc. or it could be provided by a flexible element which is held in a manner so that the element is stretched out and held in a straight line.

In an embodiment, a structure is provided which is simple, cheap and robust. Furthermore, the structure is then also flexile and can absorb shock loads and other forces without being damaged or without becoming permanently bent.

In an embodiment where said fitness element further comprises an elastic element arranged at said upper and/or lower end of said elongated structure, said elastic element being designed to allow the weight element to displace in a direction having a vector component which is perpendicular to the axis between the upper and lower ends of the elongated structure a structure is provided which allows the weight element to displace sideways with respect to the elongated structure. This provides for a more natural motion for the user. Instead of being limited to a purely linear motion, a much more "free" motion is allowed.

In an embodiment where said elastic element is designed to allow said upper and/or lower end of said elongated structure to elastically displace along a vector having a vector component which is parallel to the axis passing through said upper and lower ends, this more free motion is provided in a simple and elegant way without requiring complex mechanisms.

In an embodiment where said fitness element further comprises a shock absorbing member which is designed to absorb kinetic energy from the weight element when it is dropped from a position on the elongated structure which is located above the lower end. Damage to the weight element can be prevented while also reducing undesired shocks to the fitness element as a whole. This will increase the life expectancy of the fitness element significantly and increase the user friendliness of the element.

In an embodiment, a weight element is provided which allows the user to hold onto the weight element with one hand on either side of the elongated structure.

Additional details of the weight lifting based functional fitness elements are provided in additional dependent claims as well as in the description and figures.

It should be emphasized that the term "comprises/comprising/comprised of" when used in this specification is taken to specify the presence of stated features, integers, steps or components but does not preclude the presence or addition of one or more other features, integers, steps, components or groups thereof. For example in the claims it is written that the system comprises one standard frame element. However this should be understood as comprising at least one standard frame element. Likewise, in some of the claims a reference is made to one or two users. However, this should also be read as at least one or two users. Additional users are therefore not excluded from the scope of protection.

BRIEF DESCRIPTION OF THE DRAWINGS

In the following, the invention will be described in greater detail with reference to embodiments shown by the enclosed figures. It should be emphasized that the embodiments shown are used for example purposes only and should not be used to limit the scope of the invention.

DETAILED DESCRIPTION OF THE EMBODIMENTS

Figure 1:
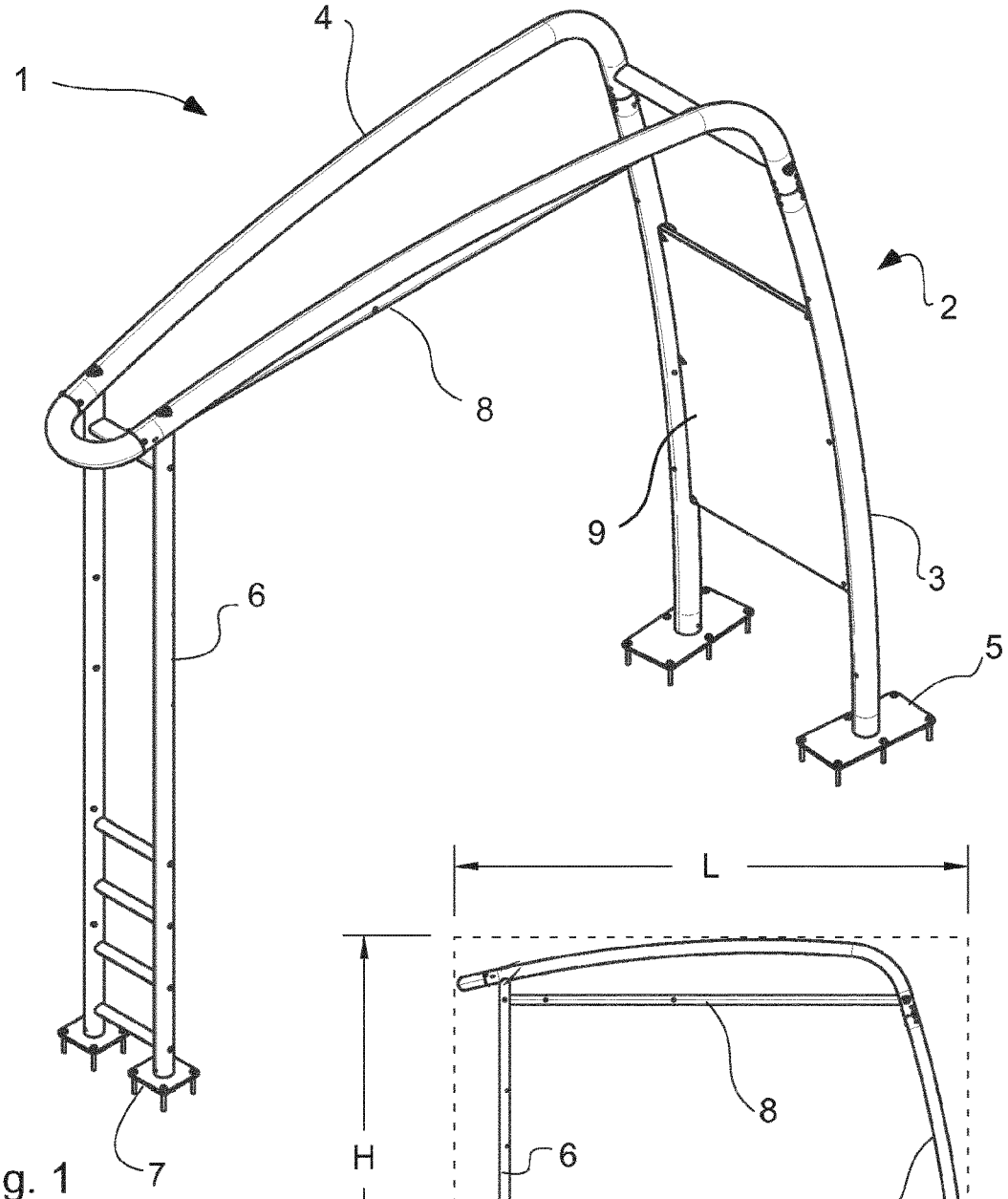
FIG. 1 shows a perspective view of an embodiment of a standard frame element according to the current invention.
Figure 2:
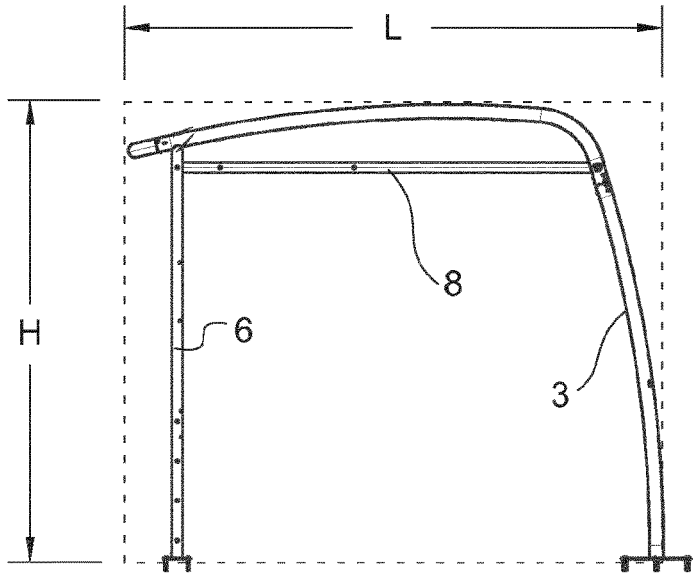
FIGS. 2 and 3 show a side and top view respectively of the standard frame element of FIG. 1.
Figure 3:
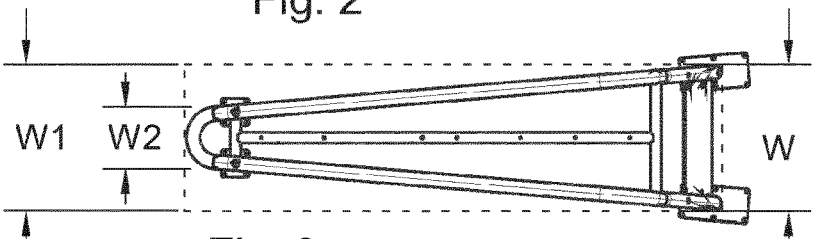

The standard frame element shown in FIGS. 1-3 is one embodiment of a standard frame element of a fitness system according to the current invention. In this embodiment, it is meant that the standard frame element of FIGS. 1-3 can be erected on a support surface and then different functional fitness elements can be mounted to and supported by the standard frame element. The standard frame element provides support for the different functional fitness elements. Different embodiments of different functional fitness elements which can be mounted to the standard frame element are disclosed later on in this specification.

In order to be able to define the dimensions of the standard frame, a virtual rectangular box is defined (dotted lines in FIGS. 2 and 3) which encloses the standard frame element. The box has a volume which is defined by a length (L), a width (W) and a height (H). For the sake of this definition, the virtual rectangular box is found by finding the rectangular box which has the minimum volume while still containing the entire frame. The height is then the dimension between the top and bottom of the box. The length is the dimension between the two vertical sides of the rectangular box which are farthest apart from each other and the width is the distance between the two sides of the rectangular box which are closest together. In certain cases, the length and the width can be the same.

In the current embodiment shown in the figures, the length is greater than the width. In the actual embodiment the length is about 3.5 times greater than the width. However other ratios could also be used, for example 2 times greater, 2.5 times greater, 3 times greater, 4 times greater or even larger.

It can also be seen in the current embodiment, especially from FIG. 3, that the local width (W1) at one side of the frame is greater than the local width (W2) at the other side of the frame. In this case, the local width is defined as the distance between the outer most portions of the frame along a vector which is perpendicular to the long side plane of the virtual rectangular box which contains the frame.

By providing a standard frame element which tapers in this manner, the torque loads which can be supported by the frame are higher than a frame having the same narrow width throughout but the material usage of the frame is lower than a frame having the same wide width throughout. Furthermore, the visual impression provided by the tapered frame is smaller than a non-tapered frame since both sides of the non-tapered frame would have to be made larger to support the same torque loads. In addition, when erecting multiple such tapered frames in a fitness assembly arrangement, a visual impression can be achieved where the frames seem to be pointing towards each other. This provides an impression of a connected fitness assembly arrangement, even though the frames are not necessarily physically connected.

The current embodiment of a standard frame element 1 has some very characteristic visual features. While additional details could be read from the figures and added to the claims if desired, it should also be noted that standard frame elements according to the current invention could be formed in many different ways and provide many different types of visual impressions.

The current embodiment 1 of a standard frame element comprises a main frame element 2 which has a generally upwards projecting portion 3 and a generally sideways projecting portion 4. The generally upwards projecting portion 3 is arranged at one side of the frame and is mounted to the ground via mounting plates 5. The mounting plates could in certain cases, depending on the underlying surface, be screwed into foundations which are placed into the supporting surface prior to erecting the frame element. The generally sideways projecting portion 4 is arranged along the top of the frame and is connected at one end to the upper end of the generally upwards projecting portion 3. A vertical frame element 6 is arranged at the side of the frame opposite to the generally upwards projecting portion 3 and is connected to the ground via mounting plates 7 at one end and to the generally sideways projecting portion 4 at its other end. A horizontal beam 8 is furthermore provided along the top of the frame for providing a connection beam for different functional fitness elements.

The frame element 1 of the current embodiment also has a plate element 9 which is fastened to the generally upwards projecting portion 3. The plate element is a metal plate having a surface area which is suitable for applying printed material which explains the use of the functional fitness element arranged in the standard frame element. In the current embodiment the generally upwards projecting portion is formed from two adjacent pipes offset from each other. The plate element is then fasted between the two adjacent pipes. In this way, the plate element 9 can also provide extra stiffness to the frame itself.

The vertical frame element 6 is in the current embodiment formed from two vertically arranged tubes which are offset from each other. The two tubes are connected by smaller tubes which function as a ladder element. These smaller tubes also provide extra stiffness to the vertical frame element 6.

Figure 4:
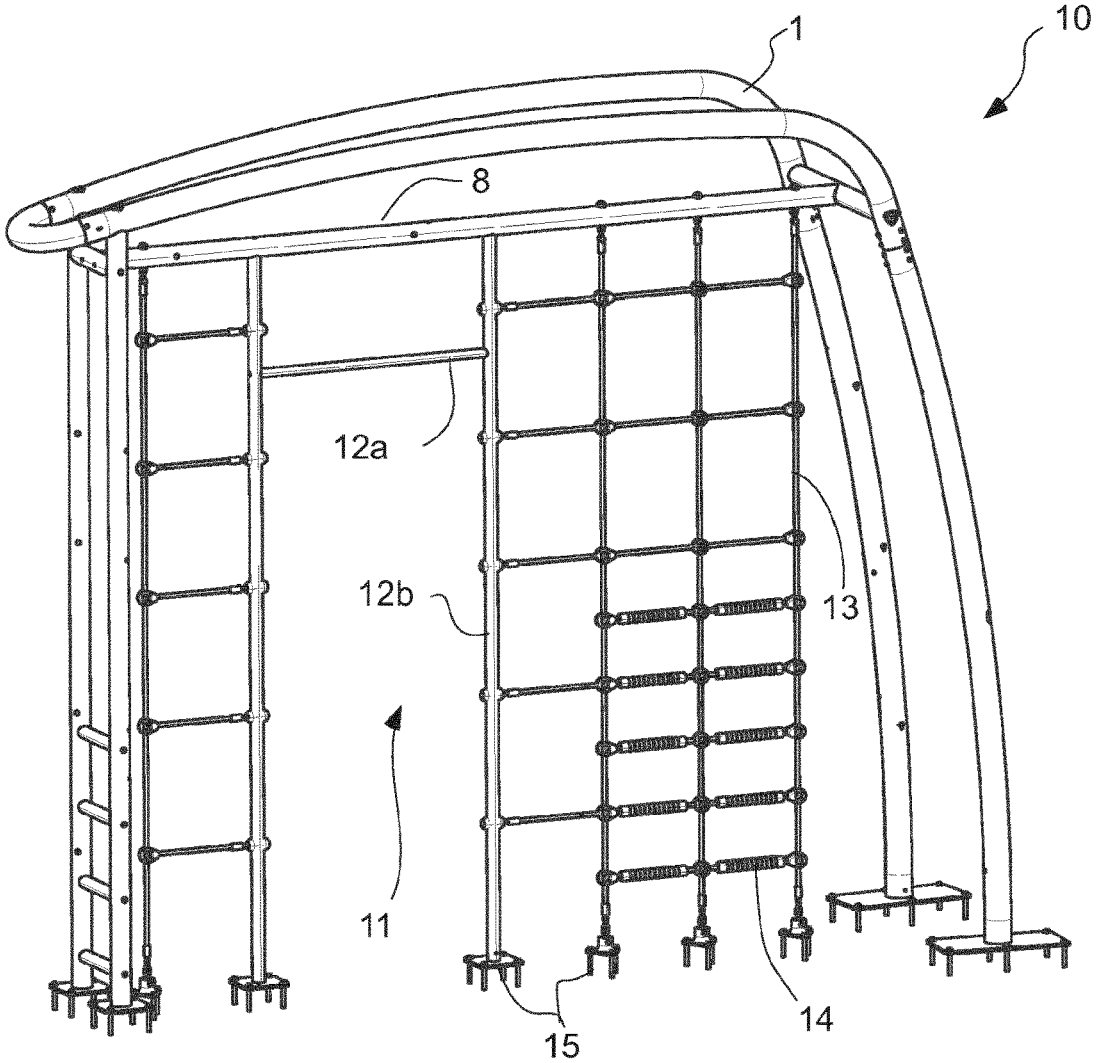
FIG. 4 shows a perspective view of a first embodiment of a fitness assembly comprising the standard frame element of FIG. 1 and a net based functional fitness element.
Figure 5:
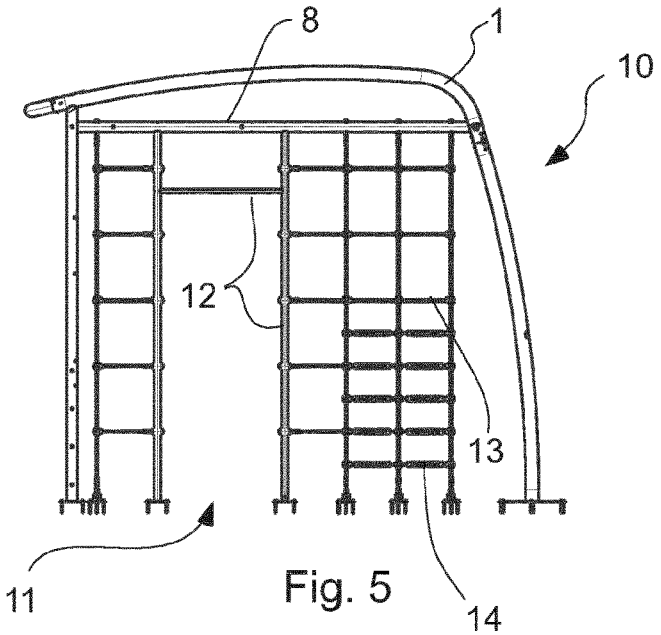
FIG. 5 shows a side view of the fitness assembly of FIG. 4.

In FIGS. 4 and 5, a first embodiment of a fitness assembly 10 is disclosed which comprises a standard frame element 1 as shown in FIGS. 1-3 and a functional fitness element 11 which in this embodiment is a net based functional fitness element. By net based is understood a functional fitness element which comprises a net like structure which can be used for many different purposes.

The current embodiment of a net based functional fitness element 11 shown in the figures comprises a mix of stiff elements 12, flexible rope like elements 13 and plastic covered rope like elements 14. The stiff elements are in the current embodiment made from vertical metal pipes 12*b* of about 48 mm in diameter and from horizontal metal pipes 12*a* of about 38 mm in diameter. The rope like elements 13 are flexible and have a thickness of about 16 mm in diameter. The plastic covered rope like elements 14 are coated with a thick layer of plastic which increases the stiffness of the rope like element while also increasing the diameter thereof to about 38 mm. In the current embodiment, the net based functional fitness element is arranged as a mix of stiff and flexible elements. However, in other embodiments, a net based functional fitness element could be provided comprising only flexible rope like elements or only stiff elements or only plastic coated flexible rope like elements.

The net based functional fitness element 11 shown in the current embodiment is fastened along its upper side to the horizontal element 8 of the standard frame element and is fastened along its lower side to the ground via plates 15 screwed into the supporting surface. The net based functional fitness element 11 shown here is arranged as a planar element and is arranged vertically. However, in other embodiments a net based functional fitness element could be provided which is arranged at an angle to the vertical. In another embodiment, two net based functional fitness elements could be arranged connected along their upper edges to a common support element but then angled outwardly to form a tent like structure with their lower edges connected to the ground at different spaced apart locations.

A net based functional fitness element 11 as shown in FIGS. 4 and 5 can be used for many different exercises. The stiff horizontal elements 12*a* in the middle of the structure can be used for example for pull ups and other exercises which need a stiff horizontal bar. The rope like elements 13 can, for example, be used for climbing exercises. The plastic covered rope like elements can for example be used as an elevated support for a user's feet when doing for example pushups with raised feet and other exercises which require support points raised from the ground. Net based functional fitness elements can therefore be arranged in many different configurations to support many different exercise forms.

Figure 6:
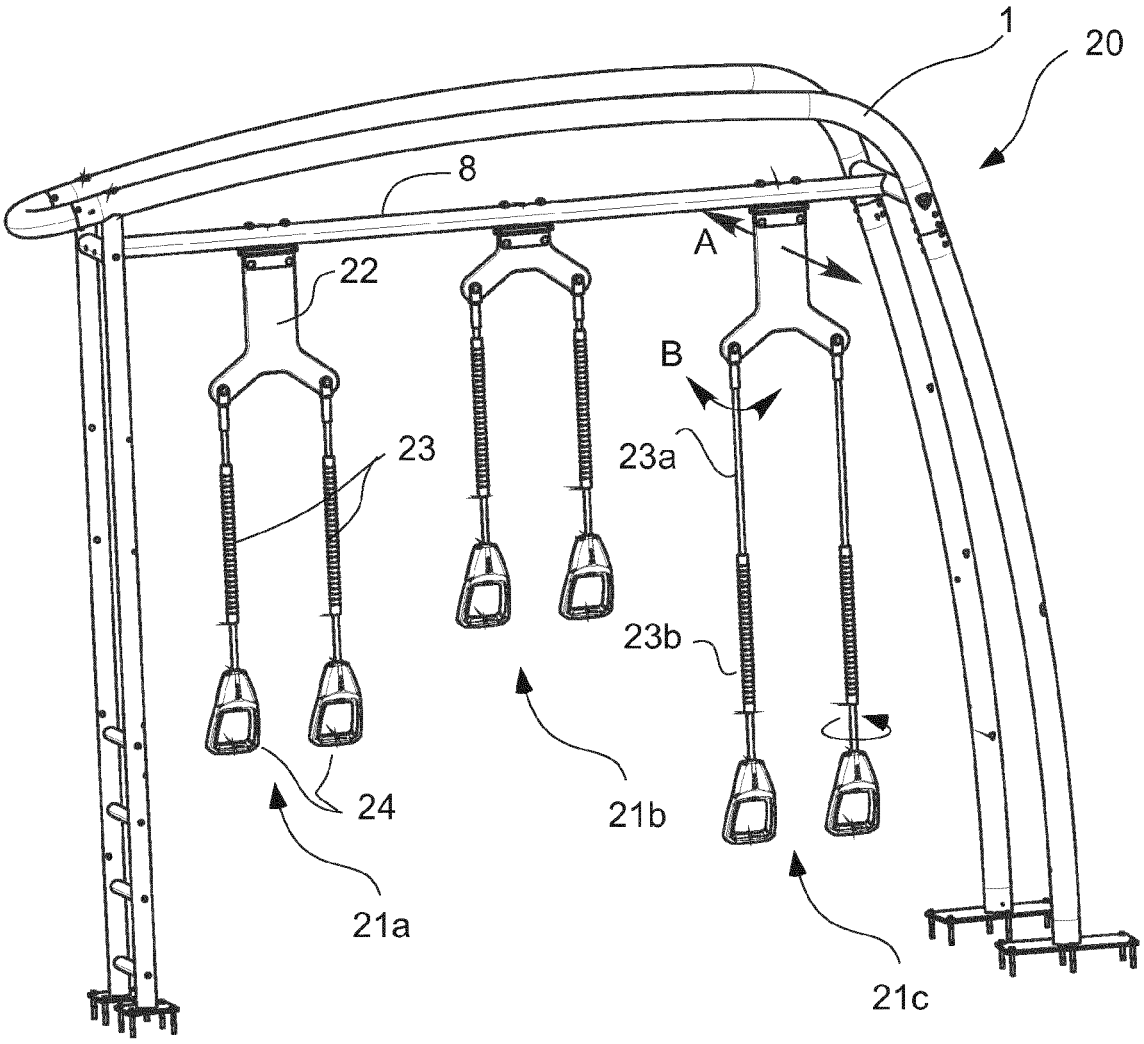
FIG. 6 shows a perspective view of a second embodiment of a fitness assembly comprising the standard frame element of FIG. 1 and three suspension training based functional fitness elements.
Figure 7:
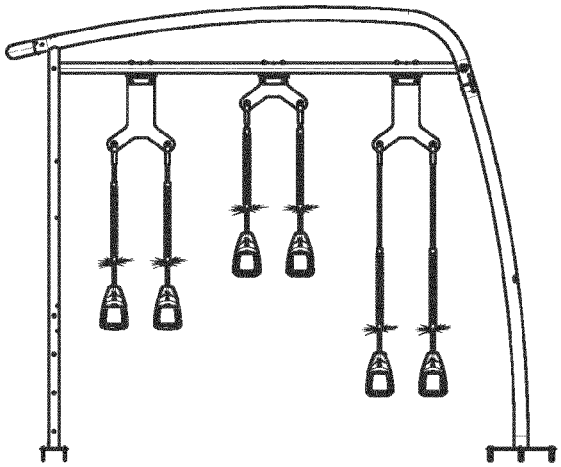
FIG. 7 shows a side view of the fitness assembly of FIG. 6.

The fitness assembly shown in FIGS. 6 and 7 is a second embodiment 20 of a fitness assembly according to the current invention. In this second embodiment, the functional fitness element is a suspension training based functional fitness element. Suspension training in its traditional form uses a strap having a handle at each end. The strap is then hung on an upper support point such that the handles dangle down below the upper support point. The handles can then be used to either support the hands or feet of a user in different exercises. Typically, straps for suspension training come in different lengths or are adjustable in length to support different types of exercises and/or different sizes of users. Other forms of traditional suspension trainers are available as two different straps which can be supported individually on an upper support element or suspension trainers are available having an upper strap portion which splits into two separate straps.

As can be seen from the figures, in this fitness assembly embodiment, three suspension training based functional fitness elements 21*a*, 21*b*, 21*c* have been provided on a single standard frame element 1. This will allow three users to simultaneously use a suspension training based functional fitness element each. Furthermore, it can be seen that the three suspension training based functional fitness elements are arranged adjacent to each other and in line with each other. In the current embodiment, the three elements are arranged along the central vertical plane of the standard frame element. In this way, three users can use the suspension training elements while standing beside each other. It can also be seen that the fitness elements are arranged such that the users can use the fitness elements while standing with their bodies facing in a direction which is perpendicular to a vertical plane passing through the two side edges of the standard frame element. In this way, the users will not necessarily be facing each other while using the suspension training elements. This will reduce the risk that a user's personal space is invaded by another user of the fitness assembly while still allowing a high user density on the standard frame element.

While traditionally available suspension trainers could be directly attached to a standard frame element, in the current embodiment, the typical straps and handles of a known suspension training element have been changed to provide additional beneficial features. In particular, instead of a flexible strap with two handles, the suspension training element according to the current embodiment comprises a planar element 22 and two elongated elements 23. The planar element is pivotably attached to the upper horizontal beam 8 and the elongated elements 23 are attached at the lower edge of the planar element. At the end of each of the elongated elements 23, a handle 24 is arranged.

As shown by the arrows A in the right of FIG. 6, the pivotable connection between the planar element and the upper support element is, in the current embodiment, designed to only allow pivotable motion about an axis which is parallel to the upper horizontal beam 8 of the frame. Furthermore, as shown by the arrows B in the right of FIG. 6, in the current embodiment, the connections between the elongated elements 23 and the planar element are arranged to only allow pivotable motion about an axis which is perpendicular to the planar element. Furthermore, the range of motion of the planar element about said axis is limited to prevent the planar element and/or the elongated elements from becoming wrapped around the upper horizontal beam 8.

In the current embodiment, the handles 24 are attached to the elongated elements such that the handles can rotate with respect to the elongated element about an axis which is parallel with the elongated element 23. In the current embodiment, the elongated elements are rope like elements 23*a* covered by plastic sheath 23*b*. In this way, high strength is provided to the elongated element via the rope like element and increased stiffness is provided via the plastic covering. However, in another embodiment, a stiff element, for example a metal pipe could have been used as the elongated element instead. Likewise, in another embodiment, a pure flexible rope like element could be used. One advantage of a stiffer elongated element is that the elongated elements will not twist around each other so much if the element is stiffer.

Furthermore, in the current embodiment, the connection between the elongated element and the planar element is pivotable, but in another embodiment, if the elongated elements are flexible enough, then the connection could be fixed. Furthermore, in the current embodiment, the connection between the elongated element and the planar element is controlled to only allow motion about a single axis, however, in other embodiments, a more free motion could be provided.

The planar element 22 in the current embodiment has an upside down Y shape where the base of the Y is pivotably attached to the horizontal beam 8 of the standard frame and the tips of the Y are each connected to an elongated element. In this embodiment, the distance between the two lower connection points is around 400 mm. This provides a good distance between the elongated elements which ensures that the force which is applied to the user by the elongated elements is mainly vertical. This is in contrast to the traditional strap suspension training arrangement where the strap is hung from a point. For short straps or for exercises which require a short strap length, the straps will have a large component of force acting inwards due to the angle the straps will have to the vertical during use. While the current embodiment has a distance of 400 mm, other distances could also be used, either shorter or longer which fulfil the same purpose of providing a more vertical load on the straps.

In the current embodiment, the planar element 22 is made from a stiff plate element. However, in other embodiments, the planar element could be made from a flexible element. Furthermore, in the current embodiment, the planar element is made from an element which has a surface area which is large enough for printing graphical information thereon. In other embodiments, a planar element could be imagined with an open frame construction which would not be suitable for printing graphical information such as usage instructions or advertising.

Figure 8:
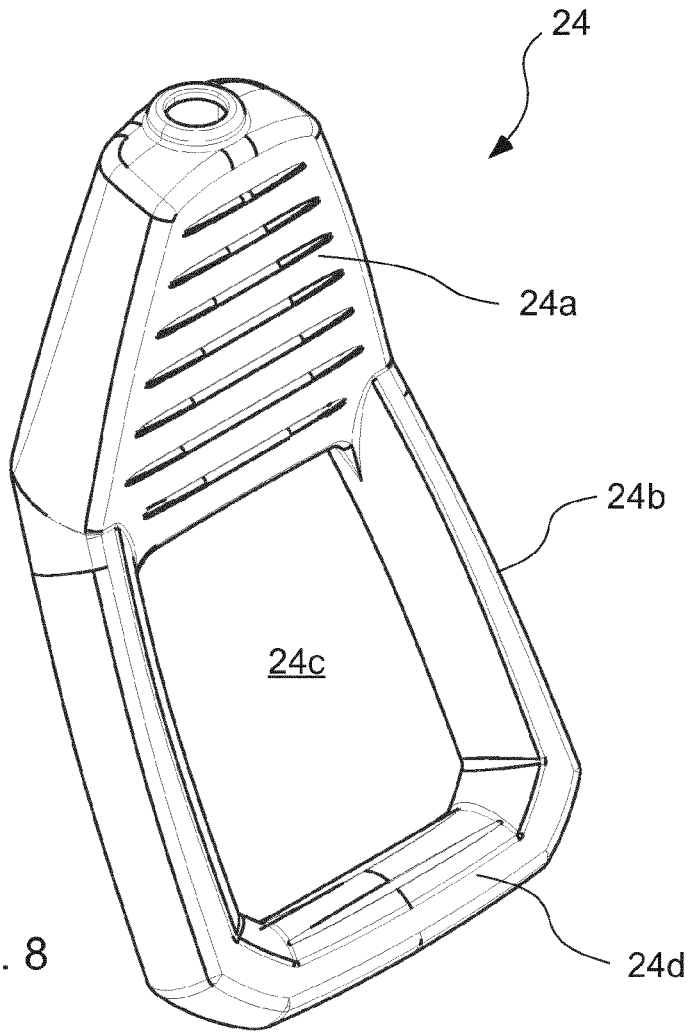
FIG. 8 shows a perspective detail view of an embodiment of a handle for a suspension training based functional fitness element.
Figure 9:
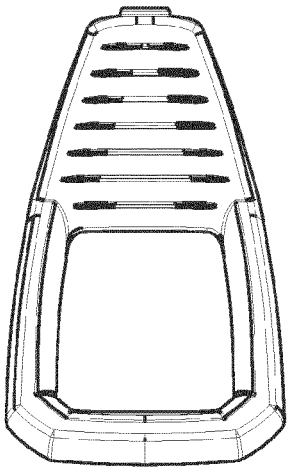
FIG. 9 shows a front view of the handle of FIG. 8.
Figure 10:
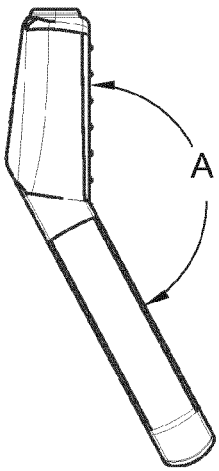
FIG. 10 shows a side view of the handle of FIG. 8.

A handle 24 of the type used in the fitness assembly of FIGS. 6-7 is shown in more detail in FIGS. 8-10. This handle is novel and could form a patentable invention in itself. The handle 24 comprises a planar portion 24*a* and a loop portion 24*b*. The loop portion defines an opening 24*c* and has a lower grip portion 24*d*. The loop portion is arranged to be suitable for supporting a user's hand or foot on the grip portion 24*d*. Furthermore, the opening is specified to be smaller than a human being's head to avoid having a child place his or her head inside the loop and getting caught. Standard sizes are defined by appropriate standards.

In the current embodiment, the planar portion 24*a* and the loop portion 24*b* form an angle A to each other of about 150 degrees. Due to this, a user can hold onto the grip portion with his or her hand and place a load on it without having the elongated element attached to the handle contact the user's arm. This effect will be further increased by increasing the stiffness of the connection between the handle and the elongated element.

Furthermore, the arrangement also allows a user to place his or her heel on the grip portion 24*d* with their toes pointing upwards and then support the ball of their foot on the planar portion. This will increase the effectiveness of the support which the handle provides to the user's foot. In this embodiment, ridges are provided on the surface of the planar portion which gives increased friction and thereby better support. While the current embodiment shows an angle of about 150 degrees between the loop portion 24*b* and the planar portion 24*a*, other angles are also possible, though typically they will be between 130 and 170 degrees, in another embodiment between 140 and 160 degrees In the current embodiment, the planar area is solid and has a surface area with ridges. However, in other embodiments, the planar area could be provided as an open frame structure. This will still provide support for the user's foot and still prevent the strap portion from contacting the user's arm during the exercise.

The fitness assembly 30 shown in FIGS. 11 to 15 is a third embodiment of a fitness assembly which is made possible by the current invention. In this case, the functional fitness element 31 is based on a weight lifting based functional fitness element. As with the previous embodiment of the fitness assembly, three functional fitness elements 31*a*, 31*b*, 31*c* have been placed inline along the longitudinal axis of the standard frame element 1. As with the previous fitness assembly, it is possible for three people to use the three different fitness elements simultaneously. Furthermore, it is possible for the three users to use the elements while facing perpendicular to the longitudinal axis of the standard frame so that the users do not need to look at each other while doing the exercises.

The basic principle of this functional fitness element is to use an elongated element 32 and support it between the ground 33 and an upper support element 34 which in this case is the upper horizontal beam 8 of the standard frame element. In the current embodiment, the elongated element is a flexible rope like element which is supported such that the rope like element is stretched out such that it forms a linear elongated element between an upper support point 34 and a lower support point 33.

A weight element 35 is fastened to the rope like element such that it is slideable up and down along the rope like element. In this embodiment an opening in the form of a through going hole is made through the weight element 35. The rope like element 32 is then fed through the through going hole. In this way, a user cannot remove the weight element from the rope like element 32. A user can then train weight lifting by lifting the weight element up and then letting it slide back down again. The user's action is shown schematically in FIGS. 12 and 13 which show a lower position in FIG. 12 and a raised position in FIG. 13.

In the current embodiment, handles 37 are provided on either side of the weight element 35. Due to the arrangement of the weight element in the current embodiment, one handle is provided on either side of the elongated element 32. When the user uses the fitness element, the user will therefore have one hand on either side of the elongated element. In another embodiment (not shown), the weight element could be formed without any handles and the user will hold the weight element directly, for example like a medicine ball. Again, the user could be holding onto the weight element with one hand on either side of the elongated element.

In order to provide extra security during the usage of the fitness element, the motion of the weight element can be controlled. In the current embodiment, a shock absorbing element 36 is arranged at the bottom of the rope like element 32. The shock absorbing element 36 is arranged in the current embodiment as a spring based system which can absorb the energy from a falling weight. If the user lets go of the weight element while it is in a raised position, the shock absorbing element will absorb the energy from the falling weight without risking that the weight element crashes into the ground.

In the current embodiment of the shock absorbing system, two springs are provided in the shock absorbing element, a shorter stiff spring 38 and a longer softer spring 39. When the weight falls down, the weight first engages the first spring 39 which starts to compress. Then the weight will engage the second spring 38 which further compresses. When the weight has stopped moving, the springs are all compressed and will push the weight back up. If there was only a single spring, the weight would be shot back up almost to the same height as it had fallen down. However, with the two spring system, the weight will not be sent so far up.

Figure 15:
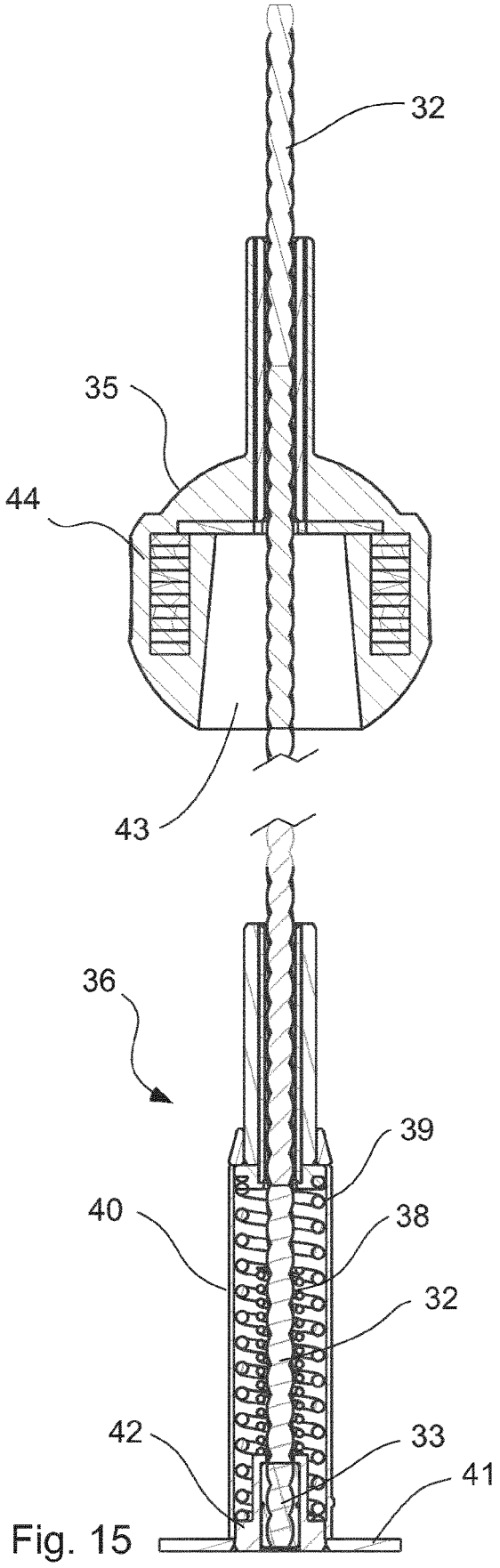
FIG. 15 shows a cross sectional view through the weight lifting based functional fitness element of FIG. 14 according to the section line XV-XV defined in FIG. 14.

Furthermore, it can be seen from FIG. 15, that the bottom 33 of the rope like element 32 is suspended via the outer softer spring 39. An outer cylindrical housing 40 is fastened to the ground via a plate element 41. The softer spring 39 is fixed at its upper end in the outer cylindrical housing 40. A bushing 42 is fastened to the bottom of the rope like element which enages with the softer spring 39. When a user pushes on the rope like element, the bottom end of the rope like element will therefore be free to displace upwardly against the force of the spring 39. By allowing the bottom of the rope like element to displace upwardly, an effect is created where it appears that the rope like element is lengthened. When the rope like element is lengthened, the weight element will be able to displace in a direction which is perpendicular to the axis between the upper and lower end of the rope like element. This provides a much more natural motion of the weight for the user and makes the exercise more useful.

In the current embodiment, the lower end of the rope like element is allowed to displace upwards due to the spring mechanism. However, in another embodiment (not shown), the upper end of the rope like element or both ends of the rope like element could be allowed to be displaced. In another embodiment (not shown), instead of allowing the end of the rope like element to displace upwards or downwards, a spring system could be provided which allows one or both ends of the rope like element to displace in a direction which has a vector component which is perpendicular to the longitudinal axis of the rope like element.

In the current embodiment, the control of the motion of the weight is provided by a spring which catches the falling weight via a spring system. In another embodiment, a spring could be built into the weight element itself. Likewise in addition to a spring, a damper could be arranged in the weight or at the bottom of the rope like element which can absorb the energy from the falling weight. For example an oil damper could be arranged in the shock absorbing element. In another embodiment (not shown) the weight element could also be provided with braking means which brake the motion of the weight element when it is dropped. These braking means could provide braking in one direction, but not the other. For example when lifting the weight, no braking is applied, but when moving the weight down, braking is applied. One way braking systems are known in the art and won't be described in more detail herein. Likewise, one could imagine a braking system where the braking effect is related to speed. When moving the weight quickly (for example when dropped) the braking system engages to slow the motion of the weight on the rope. However, moving the weight slowly would not activate the braking system.

Furthermore, as can be seen from FIG. 15, the bottom of the weight is provided with a large opening 43 which extends a significant portion of the way (in this embodiment greater than 50% of the height of the weight element) along the inside of the weight element. In particular, it can be seen that the inner diameter of this opening is greater than the outer diameter of the shock absorbing mechanism (in the current embodiment greater than 20%) and the height of the opening is less than the height of the shock absorbing mechanism. In this way, it is possible to prevent a user's hand or foot from being squeezed in the case where the weight element falls down.

In the current embodiment, three different weight elements are provided. One is 5 kg, one is 10 kg and one is 20 kg. However other combinations could also be imagined, for example, 6 kg, 12 kg, and 18 kg. In the current embodiment, lead elements 44 are embedded in the body of the weight element to provide the weight to the weight element. In another embodiment (not shown) a weight element could be provided where different weight blocks could be added or removed from the weight element to provide an adjustable weight element.

It can also be mentioned that by allowing the weight to get as close to the ground as possible, more exercises can be performed when compared to a system where the weight is not able to get as close to the ground. Therefore, it is beneficial to provide a fitness element which is designed such that the gripping area of the weight element can be arranged lower than 50 cm from the supporting surface. In another embodiment, the gripping area of the weight element can be arranged lower than 40 cm, lower than 30 cm or lower than 20 cm from the supporting surface. The term "gripping area" should be understood as the area on the weight element which is held by the user during the exercise. In the current embodiment, the weight element has multiple gripping areas. One area is the handles and another area is the lower edge of the weight element. In the case of a weight element with multiple gripping areas, all the gripping areas could be arranged as described above, or just one or more of the areas could be arranged as described above.

Figure 16:
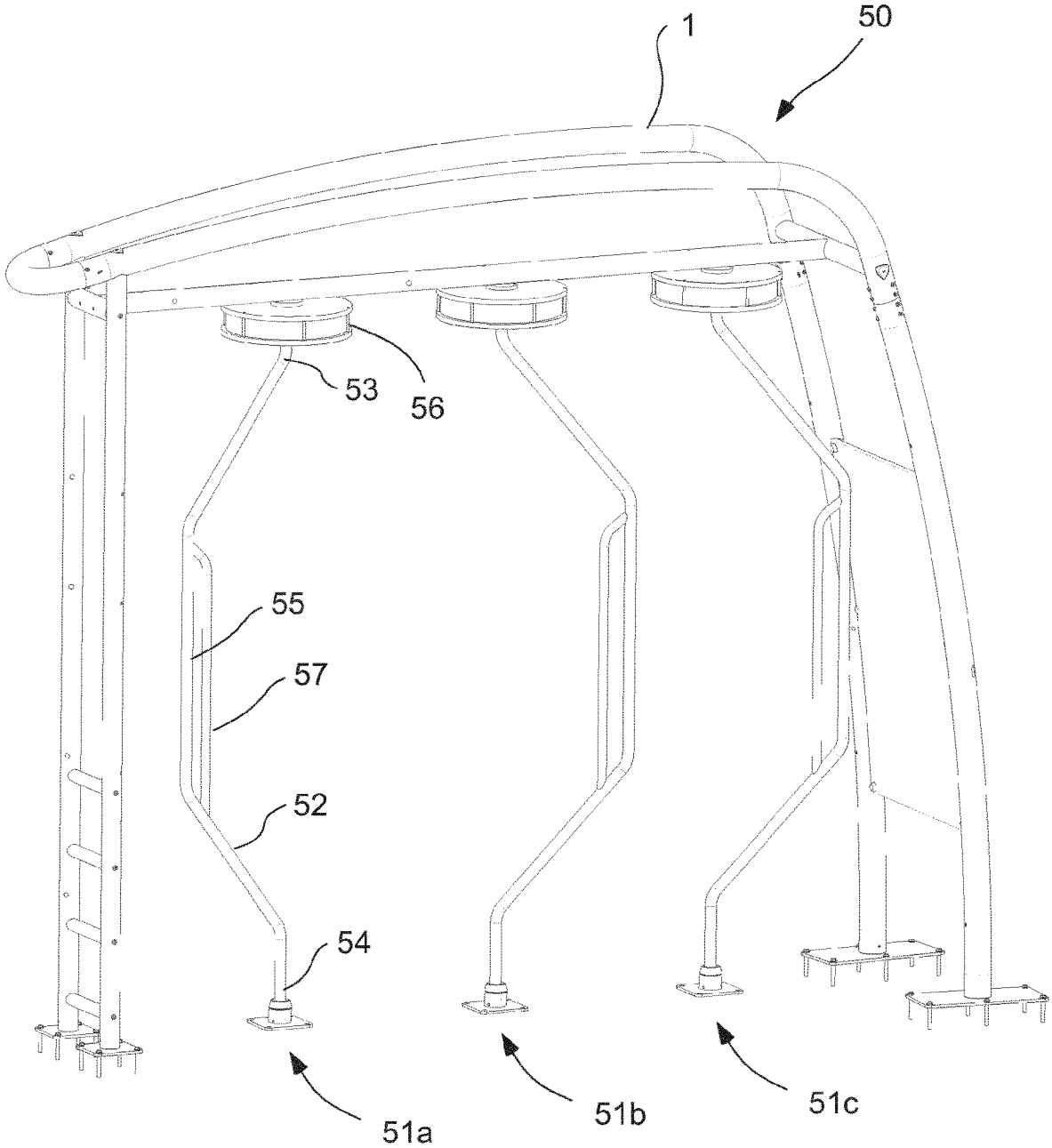
FIG. 16 shows a perspective view of a fourth embodiment of a fitness assembly comprising the standard frame element of FIG. 1 and three twisting action functional fitness elements.

The fitness assembly 50 in FIG. 16 is a fourth embodiment of a fitness assembly which is made possible by the current invention. In this case, the functional fitness element is based on a twisting action functional fitness element 51. As with the previous two fitness assemblies, also in this embodiment, three functional fitness elements 51*a*, 51*b*, 51*c* are arranged in line with each other to provide the same benefits as with the previous embodiments.

Figure 17:
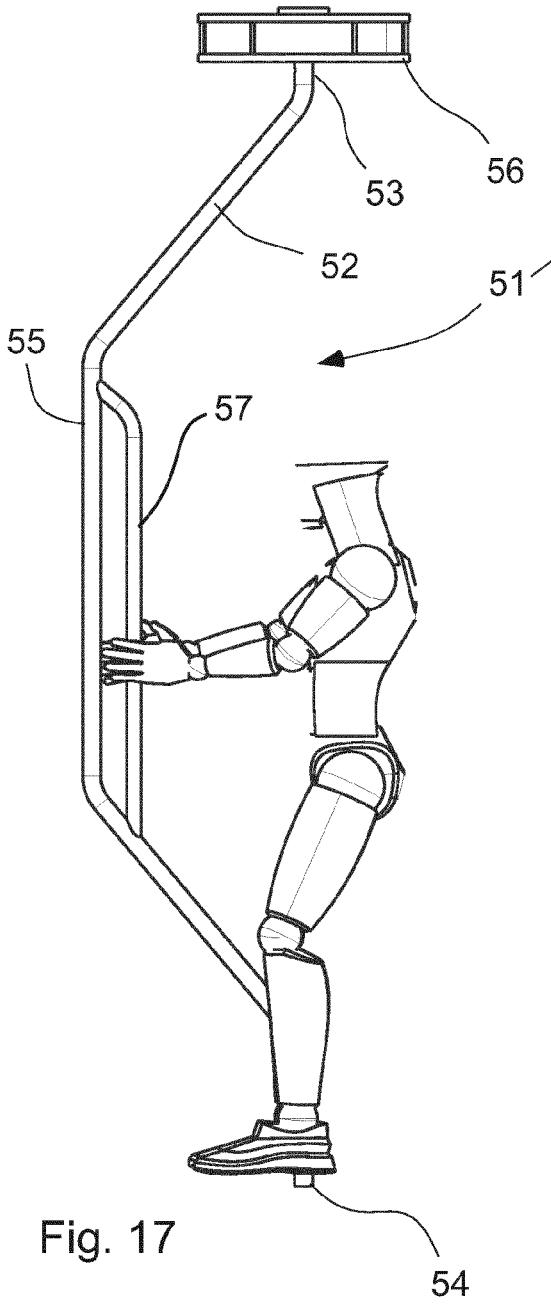
FIGS. 17 and 18 show a side and perspective view respectively of the twisting based functional fitness elements of FIG. 16.
Figure 18:
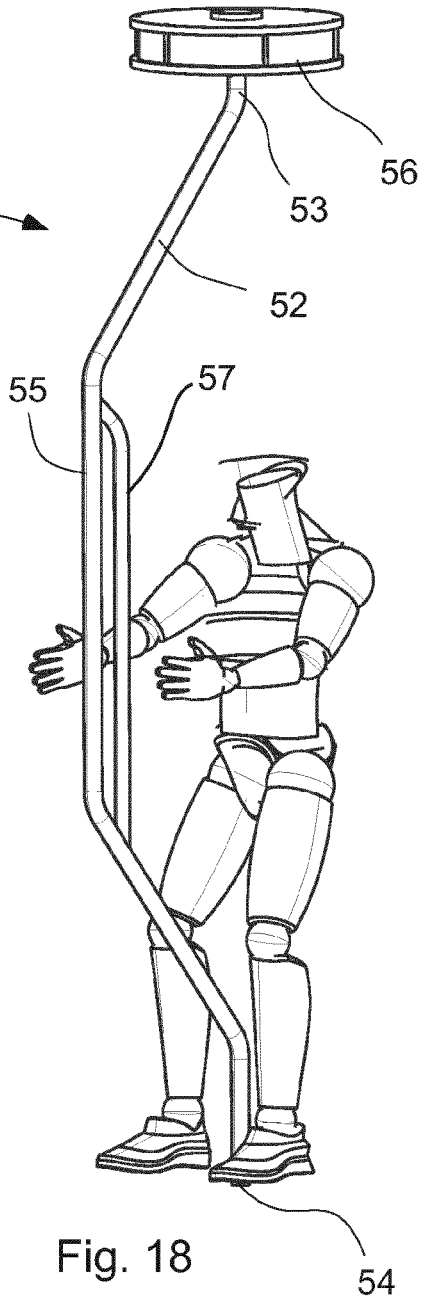

The basic principle of operation of the current embodiment is that an elongated element 52 is twisted by a user against a resistance force. An elongated element in the form of a bent metal pipe 52 is provided which is pivotably supported at its upper end 53 and its lower end 54. A portion 55 of the elongated element is offset from the axis between the upper and lower ends. A user can then hold the offset portion 55 and twist the elongated element about its rotational axis. The elongated portion 55 is a form of gripping element according to the language of the claims. A load providing element, in the current embodiment called a braking element 56, is arranged at the upper end of the elongated element to provide resistance to the rotational motion of the elongated element. In the current embodiment, the braking element is provided at the top of the elongated element, but in another embodiment (not shown) a braking element could also be provided at the lower end of the elongated element or at both the top and bottom ends. FIGS. 17 and 18 show the basic principle of operation with a single twisting action functional fitness element 51.

The braking element 56 could take many forms. In the embodiment shown in the figures, an electrical machine based braking device is used. By adjusting the load on the machine, the effort required to turn the machine will increase or decrease. In other embodiments, a friction based brake could be used where the user can control the frictional level to control how much effort is required to twist the elongated element. In such an embodiment, the force will be independent of rotational position. In another embodiment, the braking device could comprise an elastic element whereby an elastic effect is provided similar to a spring. In such an embodiment, the force becomes larger and larger as the elongated element is rotated more and more.

As can be seen from the figures, the current embodiment of the elongated element 52 has a first elongated portion 55 offset from the axis of rotation as well as a second elongated portion 57 which is also offset from the axis of rotation, but not as much as the first elongated portion 55. The first and second elongated portions 55 and 57 could be considered first and second gripping elements. A user can choose to hold onto the first or the second elongated portion. When the user holds onto the first elongated portion, the load provided by the braking element will be smaller than when the user holds onto the second elongated portion due to the difference in moment arms provided by the two elongated portions. This can be used to provide different exercises and loads to different users. Stronger users will be able to hold the inner element while weaker users will hold the outer element.

In the current embodiment, the elongated element comprises gripping elements arranged with a vertical axis and offset from the rotation axis of the elongated element. In another embodiment (not shown), the elongated element could comprise gripping elements which are arranged extending perpendicular to the rotational axis of the elongated element. For example, the elongated element could be a straight metal tubular element connecting the upper and lower ends of the elongated element. A straight bar could then be fastened to the elongated element such that it extends perpendicularly to the longitudinal axis of the elongated element. A user could then hold onto the straight bar and apply a moment to the elongated element. By holding onto the straight bar in different positions, different moments can be applied to the bar. To support users of different heights, multiple straight bars could be mounted to the elongated element at different heights. In this case, the elongated element would comprise multiple gripping elements in the form of bars connected to the elongated element at different heights.

In general, one could also mention that the fitness element shown in FIGS. 16-18 has an overall height which extends from the lower end 54 to the upper end 53. However, the fitness element also has a "working fitness range" which extends from about 75 cm above the support surface to about 180 cm above the support surface. In other words, a user can hold onto the first elongated and offset portion from about 75 cm above the support surface to about 180 cm above the support surface. This allows users of many different heights to use the fitness element. In general, one could say that a working fitness range of at least 100 cm to 150 cm can be beneficial, a working fitness range of at least 75 cm to 180 cm is more beneficial and a working fitness range of at least 50 cm to 200 cm is also more beneficial. By at least 100 cm to 150 cm, it should be understood that the fitness range starts at a position of less than 100 cm from the support surface and goes to a position greater than 150 cm from the support surface.

Figure 19:
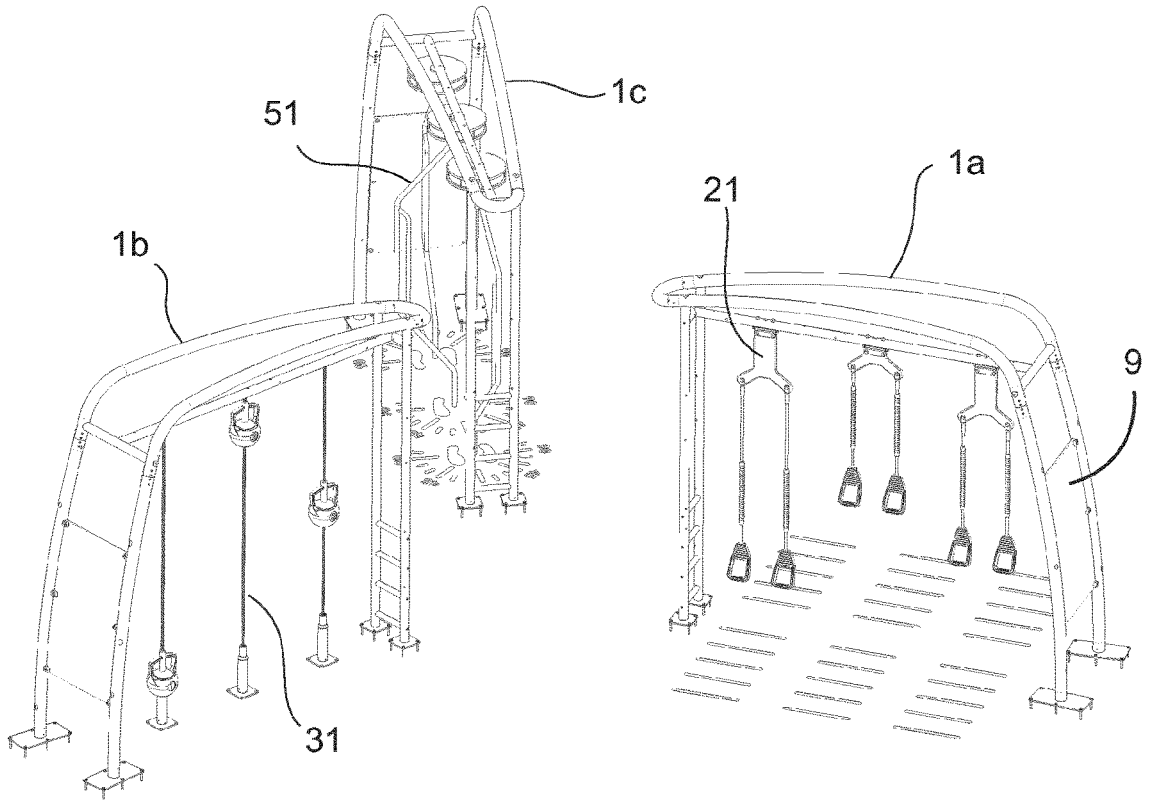
FIG. 19 shows a perspective view of a first embodiment of a fitness assembly arrangement according to the current invention, said fitness assembly arrangement made up of three identical standard frame elements and three different functional fitness elements of the fitness system according to the current invention.

By erecting multiple fitness assemblies together, a more complex fitness assembly arrangement can be provided whereby multiple different exercises can be practiced. FIG. 19 shows a fitness assembly arrangement which comprises three different standard frame elements 1*a*, 1*b*, 1*c*, each with their own functional fitness elements 21, 31, 51 arranged in the standard frame element. Furthermore, the arrangement in this case comprises floor elements which can be a part of the fitness system. The floor elements have a surface which is provided with markings, said floor elements being designed to allow creation of an assembly comprising one standard frame element, one functional fitness element mounted to and supported by the standard frame element and one floor element arranged underneath the functional fitness element where the markings of the floor element further enhance the use of the functional fitness element.

As can be seen from FIG. 19, in this embodiment of a fitness assembly arrangement the three standard frame elements are set up in a circular arrangement with the wide ends of the frames arranged at the outside of the circle and the narrow ends of the frames arranged at the inside of the circle. The three standard frame elements are arranged such that they point towards each other whereby planes going through the different standard frame elements will intersect and meet at a common axis.

It should be noted that in the current embodiment shown in FIG. 19, the different fitness elements of the fitness system are specifically designed to be used outdoors in an outdoor fitness arrangement. Designing the system for use in an outdoor environment places specific demands on the components of the system due to environmental factors which will be known to the person skilled in the art of outdoor structures. Furthermore, in an outdoor environment, the fitness elements will typically be unsupervised which also places extra demands on safety considerations. This is discussed in the section on the suspension training based functional fitness elements where a traditional fitness element could be dangerous for unsupervised use if children play on it in an un-planned way. Likewise issues such as theft and vandalism are also more relevant in an outdoor environment. Therefore all components of the system need to be fastened in some way to prevent removal when used outdoors. This is clear in the weight lifting based functional fitness element. However, it should also be noted that the inventive concepts provided in the current specification could also be used in indoor fitness systems.

Figure 20:
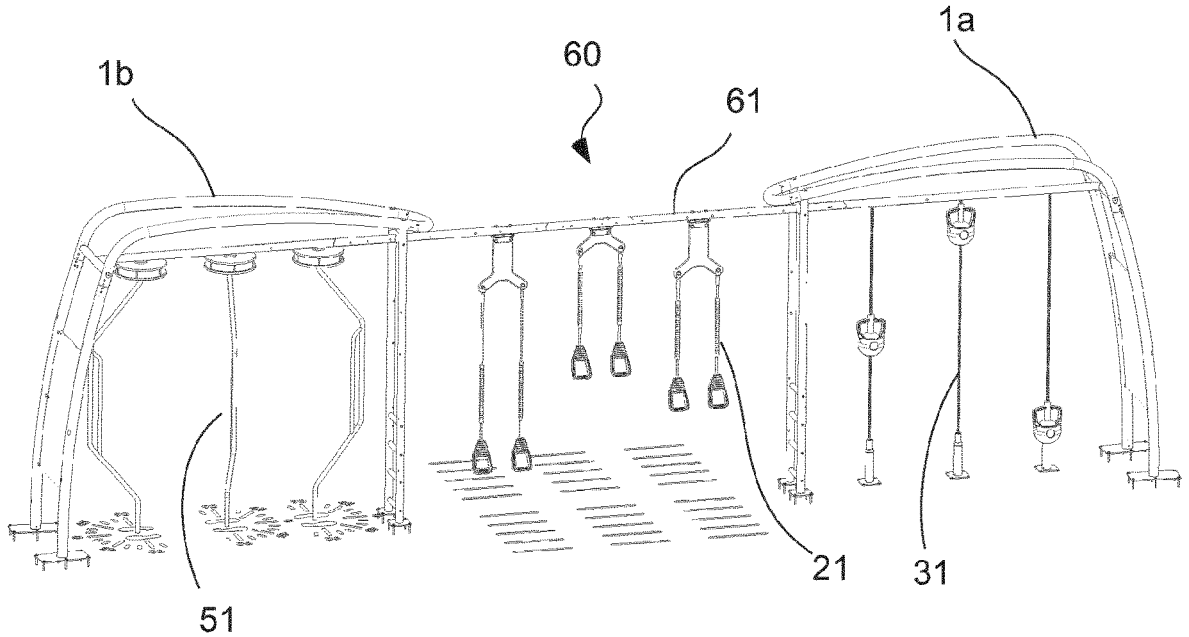
FIG. 20 shows a perspective view of a second embodiment of a fitness assembly arrangement according to the current invention.

Likewise FIG. 20 shows another fitness assembly arrangement comprising two standard frame elements 1*a*, 1*b*. In this case the two standard frame elements are arranged adjacent each other and in line with each other. It could be said that a vertical plane will pass through all the side edges of the inline frames. A link element 60 has been provided between the two standard frame elements 1*a*, 1*b*. In this case, the link element 60 comprises a horizontal beam 61 which connects the narrow ends of the two adjacent standard frame elements. It could also be said that the link element connects to the vertical side edges of the standard frame elements. By vertical side edge should be understood the vertical side surface in the case where one side of the frame has a significant area, rather than just an edge.

Additional functional fitness elements can then be attached to the link element. In the current embodiment, suspension training based functional fitness elements 21 are connected to the link element. Using such link elements, a simple structure comprising just two standard frame elements can host three separate stations.

Such link elements can also be used when there are more than two standard frame elements. One example (not shown) is a structure similar to the one shown in FIG. 19 with three standard frame elements, but where the standard frame elements are moved slightly outwards and then a link element is added between adjacent frames. In this case, three link elements could be arranged in a triangular configuration.

Figure 11:
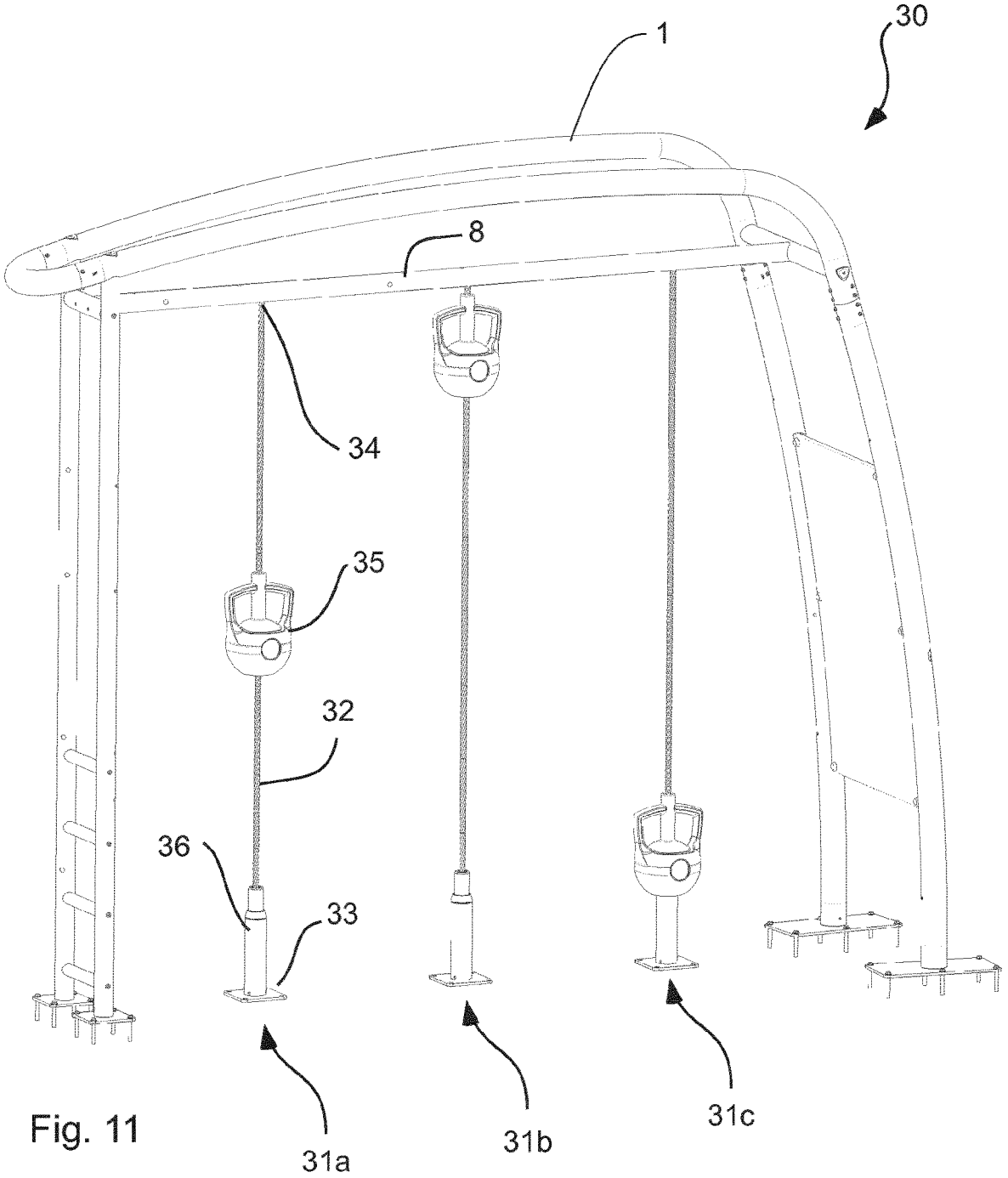
FIG. 11 shows a perspective view of a third embodiment of a fitness assembly comprising the standard frame element of FIG. 1 and three weight lifting based functional fitness elements in different positions.
Figure 12:
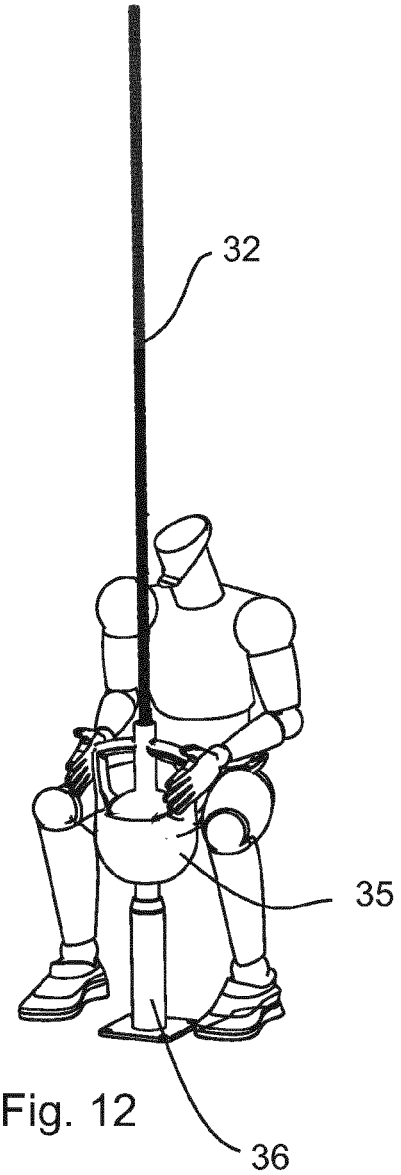
FIGS. 12 and 13 illustrate the use of a weight lifting based functional fitness element as shown in FIG. 11 in a lowered position and a raised position respectively.
Figure 13:
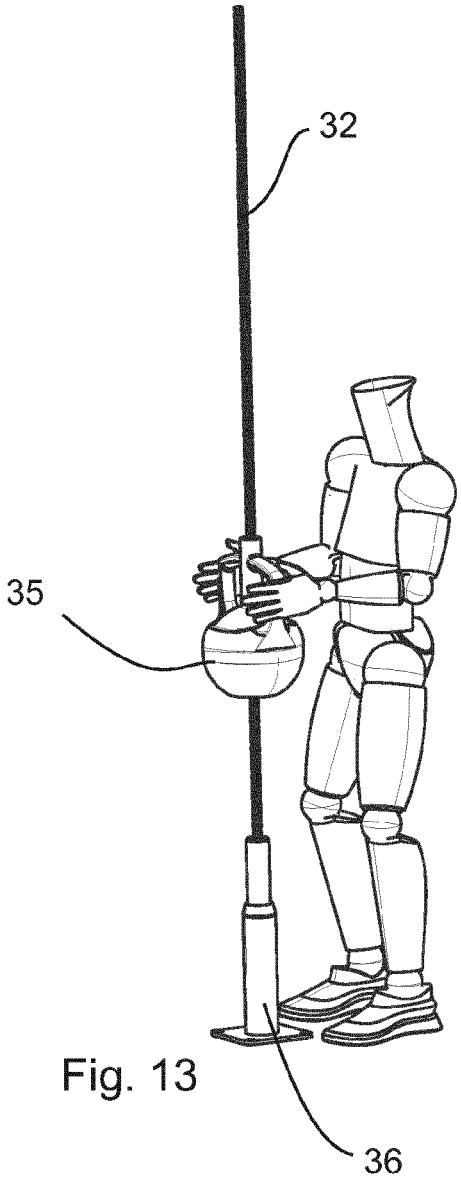
Figure 14:
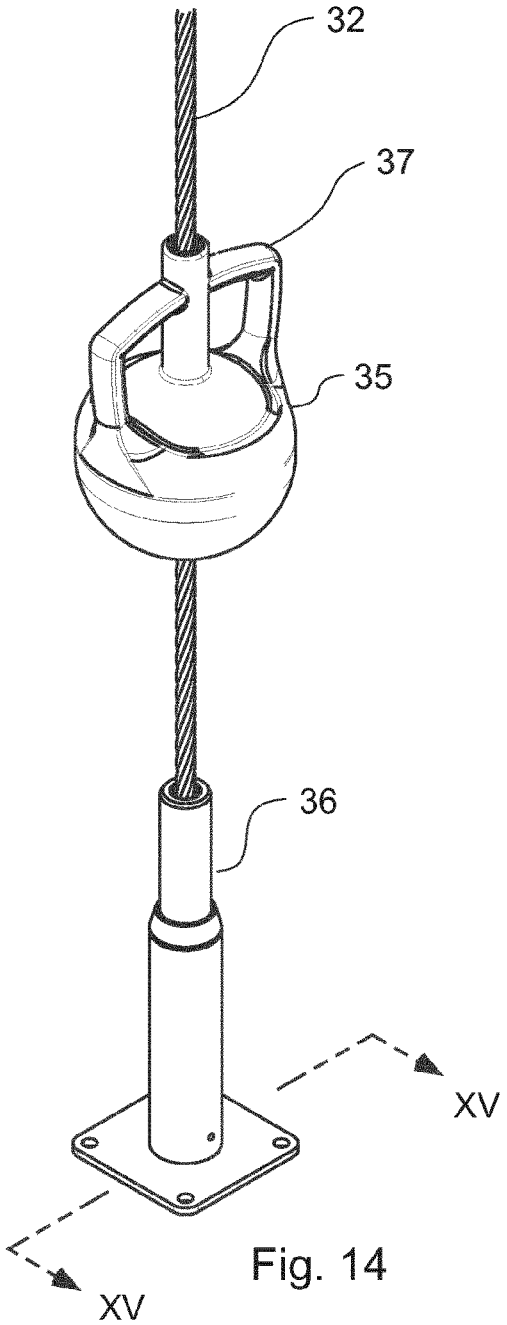
FIG. 14 shows a perspective detail view of the weight lifting based functional fitness element of FIG. 11.

Some different non limiting examples of functional fitness elements which could be connected to the link element is a rope mesh based functional fitness element similar to the arrangement of FIG. 4, a weight lifting based functional fitness element similar to FIG. 11 and a twisting based functional fitness element similar to FIG. 16.

In the embodiment shown in FIG. 20, the link element is a single horizontal beam which connects the two adjacent standard frame elements. However, in other embodiments (not shown) the link element could also be a flexible link element. For example a net based functional fitness element similar to the one shown in FIG. 4, but with only flexible elements could be provided.

In another embodiment, not shown, an upper link element could be provided in the form of a thick rope like element.

It can also be noted that in the current embodiments, similar functional fitness elements have been mounted on a single standard frame element. However, it could also be imagined that a single standard frame element had different functional fitness elements mounted on it. For example, in one embodiment (not shown), a standard frame element could be provided which had connected thereto, a twisting action functional fitness element, a suspension training based functional fitness element and a weight lifting based functional fitness element.

The invention claimed is:

1. A fitness assembly comprising a frame element and a weight lifting based functional fitness element, said weight lifting based functional fitness element comprising:

at least two elongated structures, each having a first end and a second end, and at least two weight elements, said elongated structures being designed to be supported such that the first ends are above the second ends whereby the first ends become upper ends and the second ends become lower ends and such that respective axes that pass through the upper and lower ends of said each elongated structure are arranged at an angle of less than 15 degrees, less than 10 degrees, or less than 5 degrees to the vertical, each of said weight elements being displaceably fastened to one of the elongated structures such that each of the weight elements is displaceable along one of the elongated structures, each of said elongated structures being designed and supported at respective upper and lower ends in such a way that each of the elongated structures is arranged essentially as a linear elongated structure between the respective upper and lower ends, wherein the frame element further includes an upper support element and each of said elongated structures being supported between a ground and the upper support element of the frame element, wherein each of said elongated structures has a dimension perpendicular to its said respective axis of less than 20 cm, less than 15 cm, or less than 10 cm, and the elongated structures are arranged adjacent to each other, and wherein each of said weight elements is designed to be lifted directly by a user, wherein each of said weight elements comprises handles which are arranged on either side of the respective elongated structure, wherein the at least two weight elements include two weight elements each having a different weight.

2. The fitness assembly weight lifting based functional fitness element according to claim 1, wherein each of said elongated structures comprises a flexible rope portion.

3. The fitness assembly weight lifting based functional fitness element according to claim 1, wherein said fitness element further comprises at least two shock absorbing members, each of which is designed to absorb kinetic energy from the respective weight element when the respective weight element is dropped from a position on its respective elongated structure which is located above the lower end.

4. The fitness assembly weight lifting based functional fitness element according to claim 3, wherein each of said shock absorbing members comprises a first spring and a second spring, said second spring being shorter than said first spring and having a higher spring coefficient than said first spring.

5. The fitness assembly weight lifting based functional fitness element according to claim 3, wherein each of said shock absorbing members is arranged at the lower end of the respective elongated structure or at a lower side of the respective weight element.

6. A fitness assembly comprising a frame element and a weight lifting based functional fitness element, said weight lifting based functional fitness element comprising:

at least two elongated structures, each having a first end and a second end, and at least two weight elements, said elongated structures being designed to be supported such that the first ends are above the second ends whereby the first ends become upper ends and the second ends become lower ends and such that respective axes pass through the upper and lower ends of said each elongated structure is arranged at an angle of less than 15 degrees, less than 10 degrees, or less than 5 degrees to the vertical, each of said weight elements being displaceably fastened to one of the elongated structures such that each of the weight elements is displaceable along one of the elongated structures, each of said elongated structures being designed and supported at said upper and lower ends in such a way that each of the elongated structures is arranged essentially as a linear elongated structure between its said respective upper and lower ends, the elongated structures arranged adjacent to one other, wherein the frame element includes an upper support element, and said elongated structures being supported between a ground and the upper support element of the frame element, wherein each of said elongated structures has a dimension perpendicular to said axis of less than 20 cm, less than 15 cm, or less than 10 cm, and wherein each of said weight elements is designed to be lifted directly by a user by holding each of the weight elements with one hand on either side of each of the elongated structures, wherein the at least two weight elements include two weight elements each having a different weight.

7. The fitness assembly weight lifting based functional fitness element according to claim 6, wherein each of said elongated structures comprises a flexible rope portion.

8. A fitness assembly comprising a frame element and a weight lifting based functional fitness element, said weight lifting based functional fitness element comprising:

a plurality of elongated structures, each having a first end and a second end, and a plurality of weight elements, each of the plurality of weight elements having a different weight, wherein each of the plurality of weight elements are fixed weights;

each of said elongated structures being designed to be supported such that the first end is above the second end whereby the first end becomes an upper end and the second end becomes a lower end and such that respective axes pass through the upper and lower ends of each of said elongated structures is arranged at an angle of less than 15 degrees, less than 10 degrees, or less than 5 degrees to the vertical, each of said weight elements being displaceably fastened to one of the elongated structures such that each of the weight elements is displaceable along one of the elongated structures, each of said elongated structures being designed and supported at said upper and lower ends in such a way that each of the elongated structures is arranged as a linear elongated structure between the respective upper and lower ends, the elongated structures arranged adjacent to one other, said elongated structures being supported between a ground and an upper support element of the frame element, and while at rest, each of the elongated structures extends entirely along one of the respective axes-axis between the ground and the upper support element, wherein each of said elongated structures has a dimension perpendicular to said axis of less than 20 cm, less than 15 cm, or less than 10 cm, wherein each of said weight elements is designed to be lifted directly by a user, by holding each of the weight elements with one hand on either side of the elongated structures, wherein the plurality of weight elements includes weight elements each having a different weight, and wherein each of the plurality of weight elements is configured to be pushed upward relative to its respective elongated structure by a force from a user, and in absence of the force, is configured to slide downward relative to its respective elongated structure by gravity.

9. The fitness assembly weight lifting based functional fitness element according to claim 8, wherein each of said elongated structures comprises a flexible rope portion.

10. The fitness assembly according to claim 1, wherein each weight element is configured to be moved upward along its respective elongated structure by a force from the user, wherein in absence of the force, each weight element is configured to slide downward relative to its respective elongated structure by gravity.

11. The fitness assembly weight lifting based functional fitness element according to claim 1, wherein each of said weight elements includes a first handle and a second handle, the first handle and second handles both extending from the weight 180 degrees opposite of one another relative to said elongated structure.

12. The fitness assembly weight lifting based functional fitness element according to claim 4, wherein said first spring and said second spring are aligned on a single lower end of a single of the two elongated structures.

13. The fitness assembly weight lifting based functional fitness element according to claim 1, wherein each of the at least two weight elements are fixed weights.

14. The fitness assembly weight lifting based functional fitness element according to claim 1, wherein the user cannot remove each of said weight elements from each of the respective elongated elements.

15. The fitness assembly weight lifting based functional fitness element according to claim 6, wherein the user cannot remove each of said weight elements from each of the respective elongated elements.

16. The fitness assembly weight lifting based functional fitness element according to claim 8, wherein the user cannot remove each of said weight elements from each of the respective elongated elements.

17. The fitness assembly weight lifting based functional fitness element according to claim 8, where the plurality of elongated structures and the plurality of weight elements is three.

* * * * *